US011495163B2

(12) United States Patent
Wang et al.

(10) Patent No.: US 11,495,163 B2
(45) Date of Patent: Nov. 8, 2022

(54) GRAYSCALE COMPENSATION METHOD, GRAYSCALE COMPENSATION ASSEMBLY, AND LIQUID CRYSTAL DISPLAY DEVICE

(71) Applicants: Beijing BOE Optoelectronics Technology Co., Ltd., Beijing (CN); BOE Technology Group Co., Ltd., Beijing (CN)

(72) Inventors: Xiaojing Wang, Beijing (CN); Hao Zhang, Beijing (CN); Wenhong Tian, Beijing (CN); Zijiao Xue, Beijing (CN); Nan Han, Beijing (CN); Shuaishuai Xu, Beijing (CN); Xinjie Huang, Beijing (CN)

(73) Assignees: Beijing BOE Optoelectronics Technology Co., Ltd., Beijing (CN); BEIJING BOE TECHNOLOGY, Beijing (CN)

( * ) Notice: Subject to any disclaimer, the term of this patent is extended or adjusted under 35 U.S.C. 154(b) by 0 days.

(21) Appl. No.: 17/542,044

(22) Filed: Dec. 3, 2021

(65) Prior Publication Data

US 2022/0180793 A1 Jun. 9, 2022

(30) Foreign Application Priority Data

Dec. 8, 2020 (CN) ..... 202011441934.0

(51) Int. Cl.
*G09G 3/20* (2006.01)
*G09G 3/36* (2006.01)

(52) U.S. Cl.
CPC ..... *G09G 3/2074* (2013.01); *G09G 3/3607* (2013.01); *G09G 2320/0285* (2013.01); *G09G 2340/16* (2013.01); *G09G 2360/145* (2013.01)

(58) Field of Classification Search
CPC ..... G09G 3/2074; G09G 3/3607; G09G 2320/0285; G09G 2340/16; G09G 2360/145
See application file for complete search history.

(56) References Cited

U.S. PATENT DOCUMENTS 9,053,674 B2 * 6/2015 Chen ..... G09G 3/3611
2005/0052389 A1 * 3/2005 Sawabe ..... G09G 3/3644 345/89

(Continued)

*Primary Examiner* — Antonio Xavier
(74) *Attorney, Agent, or Firm* — IPRO, PLLC

(57) ABSTRACT

The present disclosure provides a grayscale compensation method, a gray-scale compensation assembly, and a liquid crystal display device. The gray-scale compensation method includes: detecting a display region for compensation in the liquid crystal display screen that needs grayscale compensation under a reserved liquid crystal response time; acquiring a grayscale conversion timetable of the liquid crystal display screen, and obtaining a limit value of conversion time of the liquid crystal display screen according to the grayscale conversion timetable; acquiring a compensation grayscale lookup table of the display region for compensation; comparing the reserved liquid crystal response time and the limit value of conversion time to obtain a time comparison result; performing grayscale compensation on the display region according to the time comparison result, the grayscale conversion timetable and the compensation grayscale lookup table.

14 Claims, 6 Drawing Sheets

(56) References Cited

U.S. PATENT DOCUMENTS

| | | | | |
|---|---|---|---|---|
| 2008/0192034 | A1* | 8/2008 | Chen | G09G 3/3611 345/204 |
| 2009/0091524 | A1* | 4/2009 | Lomas | G09G 3/3611 345/87 |
| 2010/0188382 | A1* | 7/2010 | Chen | G09G 3/36 345/211 |
| 2011/0063330 | A1* | 3/2011 | Bae | G09G 3/3611 345/88 |
| 2011/0169851 | A1* | 7/2011 | Chiu | G09G 3/3648 345/561 |
| 2011/0310134 | A1* | 12/2011 | Nakatsuka | G09G 3/3406 345/102 |
| 2013/0127699 | A1* | 5/2013 | Atkinson | G09G 3/3406 345/101 |
| 2017/0140694 | A1* | 5/2017 | Chen | G09G 3/2077 |
| 2018/0240424 | A1* | 8/2018 | Aoki | G09G 3/3406 |
| 2019/0259348 | A1* | 8/2019 | Han | G09G 3/3688 |
| 2021/0272526 | A1* | 9/2021 | Xu | G02F 1/1345 |

* cited by examiner

| ms(millisecon) | | previous frame grayscale | | | | | | | | |
|---|---|---|---|---|---|---|---|---|---|---|
| | | L11 | L12 | L13 | L14 | L15 | L16 | L17 | L18 | L19 |
| target frame grayscale | L21 | A11 | A21 | A31 | A41 | A51 | A61 | A71 | A81 | A91 |
| | L22 | A12 | A22 | A32 | A42 | A52 | A62 | A72 | A82 | A92 |
| | L23 | A13 | A23 | A33 | A43 | A53 | A63 | A73 | A83 | A93 |
| | L24 | A14 | A24 | A34 | A44 | A54 | A64 | A74 | A84 | A94 |
| | L25 | A15 | A25 | A35 | A45 | A55 | A65 | A75 | A85 | A95 |
| | L26 | A16 | A26 | A36 | A46 | A56 | A66 | A76 | A86 | A96 |
| | L27 | A17 | A27 | A37 | A47 | A57 | A67 | A77 | A87 | A97 |
| | L28 | A18 | A28 | A38 | A48 | A58 | A68 | A78 | A88 | A98 |
| | L29 | A19 | A29 | A39 | A49 | A59 | A69 | A79 | A89 | A99 |

Fig. 4

| Ms (millisecond) | | previous frame grayscale | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| target frame grayscale | 0 | 0 | 1.365 | 1.506 | 1.482 | 1.579 | 1.561 | 1.584 | 1.751 | 1.643 | 1.716 | 1.641 | 1.649 | 1.715 | 1.687 | 1.712 | 1.737 | 1.76 |
| | 16 | 1.932 | 0 | 0.885 | 1.507 | 1.643 | 1.679 | 1.819 | 1.718 | 1.692 | 1.641 | 1.699 | 1.737 | 1.715 | 1.772 | 1.768 | 1.792 | 1.79 |
| | 32 | 2.327 | 1.985 | 0 | 1.18 | 1.65 | 1.978 | 2.072 | 1.924 | 2.045 | 2.016 | 1.985 | 1.092 | 2.065 | 2.05 | 2.103 | 2.106 | 2.147 |
| | 48 | 2.398 | 2.548 | 1.972 | 0 | 1.308 | 1.954 | 2.238 | 2.084 | 2.124 | 2.2 | 2.195 | 2.121 | 2.178 | 2.189 | 2.241 | 2.222 | 2.179 |
| | 64 | 2.873 | 2.872 | 3.052 | 2.399 | 0 | 1.183 | 1.689 | 2.021 | 2.02 | 2.247 | 2.288 | 2.195 | 2.212 | 2.203 | 2.233 | 2.194 | 2.235 |
| | 80 | 2.906 | 2.823 | 3.046 | 3.107 | 2.517 | 0 | 1.279 | 1.279 | 2.086 | 2.355 | 2.167 | 2.272 | 2.296 | 2.328 | 2.563 | 2.428 | 2.552 |
| | 96 | 3.051 | 3.207 | 3.249 | 3.125 | 2.869 | 2.52 | 0 | 1.078 | 2 | 1.937 | 2.528 | 2.32 | 2.432 | 2.445 | 2.376 | 2.351 | 2.452 |
| | 112 | 3.573 | 3.231 | 3.148 | 3.162 | 2.836 | 2.788 | 2.27 | 0 | 1.168 | 1.59 | 1.913 | 2.145 | 2.332 | 2.326 | 2.287 | 2.276 | 2.37 |
| | 128 | 3.37 | 3.245 | 3.026 | 3.125 | 1.561 | 3.158 | 2.748 | 2.511 | 0 | 1.246 | 1.695 | 2.197 | 2.23 | 2.158 | 2.455 | 2.473 | 2.547 |
| | 144 | 3.052 | 3.088 | 3.06 | 3.253 | 1.561 | 3.224 | 3.183 | 2.355 | 2.097 | 0 | 1.305 | 2.054 | 2.246 | 2.276 | 2.478 | 2.477 | 2.481 |
| | 160 | 3.118 | 3.024 | 3.071 | 3.247 | 1.561 | 2.994 | 2.913 | 2.678 | 2.664 | 1.761 | 0 | 1.477 | 2.002 | 2.282 | 2.353 | 2.386 | 2.438 |
| | 176 | 2.979 | 3.046 | 2.93 | 3.024 | 1.561 | 2.857 | 2.908 | 2.531 | 2.915 | 2.392 | 1.983 | 0 | 1.398 | 2.21 | 2.135 | 2.261 | 2.466 |
| | 192 | 2.806 | 2.749 | 2.788 | 2.906 | 1.561 | 2.84 | 2.801 | 2.495 | 2.748 | 2.481 | 2.182 | 2.1 | 0 | 1.702 | 2.109 | 2.447 | 2.443 |
| | 208 | 2.707 | 2.629 | 2.738 | 2.808 | 1.561 | 3.127 | 2.666 | 2.44 | 2.48 | 2.348 | 2.193 | 2.31 | 2.112 | 0 | 1.404 | 2.258 | 2.472 |
| | 224 | 2.539 | 2.47 | 2.476 | 2.501 | 1.561 | 2.872 | 2.531 | 2.196 | 2.204 | 2.149 | 2.186 | 2.143 | 2.145 | 1.8 | 0 | 1.709 | 2.16 |
| | 240 | 2.31 | 2.23 | 2.198 | 2.288 | 1.561 | 2.197 | 2.231 | 2.067 | 2.056 | 2.009 | 1.879 | 1.864 | 1.943 | 1.787 | 1.628 | 0 | 2.249 |
| | 255 | 1.868 | 1.807 | 1.861 | 1.861 | 1.561 | 1.75 | 1.8 | 1.756 | 1.748 | 1.727 | 1.643 | 1.661 | 1.907 | 1.82 | 1.772 | 1.525 | 0 |

Fig. 5

| | | previous frame grayscale | | | | | | | | |
|---|---|---|---|---|---|---|---|---|---|---|
| | | L31 | L32 | L33 | L34 | L35 | L36 | L37 | L38 | L39 |
| target frame grayscale | L41 | H11 | H21 | H31 | H41 | H51 | H61 | H71 | H81 | H91 |
| | L42 | H12 | H22 | H32 | H42 | H52 | H62 | H72 | H82 | H92 |
| | L43 | H13 | H23 | H33 | H43 | H53 | H63 | H73 | H83 | H93 |
| | L44 | H14 | H24 | H34 | H44 | H54 | H64 | H74 | H84 | H94 |
| | L45 | H15 | H25 | H35 | H45 | H55 | H65 | H75 | H85 | H95 |
| | L46 | H16 | H26 | H36 | H46 | H56 | H66 | H76 | H86 | H96 |
| | L47 | H17 | H27 | H37 | H47 | H57 | H67 | H77 | H87 | H97 |
| | L48 | H18 | H28 | H38 | H48 | H58 | H68 | H78 | H88 | H98 |
| | L49 | H19 | H29 | H39 | H49 | H59 | H69 | H79 | H89 | H99 |

Fig. 6

| | | previous frame grayscale | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| target frame grayscale | 0 | 0 | 0 | 0 | 0 | 0 | 0 | 0 | 0 | 0 | 0 | 0 | 0 | 0 | 0 | 0 | 0 | 0 |
| | 16 | 16 | 0 | 0 | 0 | 0 | 0 | 0 | 0 | 0 | 0 | 0 | 0 | 0 | 0 | 0 | 0 | 0 |
| | 32 | 40 | 0 | 0 | 32 | 22 | 6 | 0 | 0 | 0 | 0 | 0 | 0 | 0 | 0 | 0 | 0 | 0 |
| | 48 | 58 | 56 | 0 | 0 | 48 | 38 | 28 | 22 | 0 | 0 | 0 | 0 | 0 | 0 | 0 | 0 | 0 |
| | 64 | 82 | 88 | 80 | 74 | 0 | 64 | 54 | 46 | 20 | 14 | 0 | 0 | 0 | 0 | 0 | 0 | 0 |
| | 80 | 100 | 104 | 98 | 100 | 88 | 0 | 80 | 70 | 56 | 46 | 38 | 20 | 8 | 0 | 0 | 0 | 0 |
| | 96 | 114 | 128 | 128 | 128 | 112 | 110 | 0 | 96 | 86 | 80 | 70 | 60 | 30 | 24 | 6 | 0 | 0 |
| | 112 | 150 | 144 | 138 | 138 | 134 | 132 | 120 | 0 | 112 | 104 | 98 | 90 | 74 | 54 | 26 | 12 | 0 |
| | 128 | 172 | 166 | 164 | 160 | 158 | 158 | 142 | 136 | 0 | 128 | 122 | 114 | 96 | 84 | 70 | 50 | 30 |
| | 144 | 182 | 186 | 176 | 180 | 176 | 180 | 166 | 158 | 150 | 0 | 144 | 132 | 124 | 112 | 90 | 86 | 74 |
| | 160 | 198 | 200 | 198 | 1847 | 188 | 188 | 184 | 178 | 176 | 166 | 0 | 160 | 150 | 144 | 132 | 116 | 104 |
| | 176 | 214 | 212 | 212 | 210 | 208 | 208 | 202 | 200 | 198 | 184 | 182 | 0 | 176 | 170 | 158 | 146 | 134 |
| | 192 | 232 | 230 | 226 | 226 | 224 | 224 | 220 | 218 | 218 | 208 | 206 | 198 | 0 | 1925 | 1847 | 176 | 172 |
| | 208 | 242 | 240 | 240 | 236 | 236 | 240 | 236 | 232 | 230 | 224 | 222 | 220 | 214 | 0 | 208 | 204 | 197 |
| | 224 | 254 | 254 | 250 | 248 | 248 | 250 | 242 | 242 | 244 | 242 | 238 | 238 | 236 | 228 | 0 | 224 | 220 |
| | 240 | 255 | 255 | 255 | 255 | 255 | 255 | 255 | 255 | 255 | 253 | 252 | 252 | 250 | 250 | 246 | 0 | 240 |
| | 255 | 255 | 255 | 255 | 255 | 255 | 255 | 255 | 255 | 255 | 255 | 255 | 255 | 255 | 255 | 255 | 255 | 0 |

Fig. 7

GRAYSCALE COMPENSATION METHOD, GRAYSCALE COMPENSATION ASSEMBLY, AND LIQUID CRYSTAL DISPLAY DEVICE

CROSS-REFERENCE TO RELATED APPLICATION

The present application claims the priority of Chinese Patent Application No. 202011441934.0 filed on Dec. 8, 2020, the contents of which are incorporated herein in their entirety by reference.

TECHNICAL FIELD

The present disclosure relates to the field of grayscale compensation technology, and in particular to a grayscale compensation method, a gray-scale compensation assembly and a liquid crystal display device.

BACKGROUND

For higher definition, the display screen of VR (virtual reality) glasses is gradually developing towards high PPI (pixel density) and high frame rate. However, during driving the liquid crystal display, due to the limited response speed of the liquid crystal, it is difficult to achieve the desired deflection angle within one frame, so that the display brightness is not as expected, and smearing occurs in the dynamic image, which affects the display effect. In the related art, the overdrive technology (OD for short) can be used to perform grayscale compensation, so that the liquid crystal can reach the desired deflection target in a relatively short time.

SUMMARY

The present disclosure provides a grayscale compensation method applied to a liquid crystal display device including a liquid crystal display screen; the grayscale compensation method including:

detecting a display region for compensation in the liquid crystal display screen that needs grayscale compensation under a reserved liquid crystal response time, the reserved liquid crystal response time being a response time reserved for the liquid crystal of the liquid crystal display screen in one frame time;

acquiring a grayscale conversion timetable of the liquid crystal display screen, and obtaining a limit value of conversion time of the liquid crystal display screen according to the grayscale conversion timetable;

acquiring a compensation grayscale lookup table of the display region for compensation;

comparing the reserved liquid crystal response time and the limit value of conversion time to obtain a time comparison result; when the liquid crystal display screen displays under the reserved liquid crystal response time, performing gray-scale compensation on the display region according to the time comparison result, the grayscale conversion timetable and the compensation grayscale lookup table.

Optionally, a number of the display region for compensation is N, and N is a positive integer;

the step of detecting the display region for compensation in the liquid crystal display screen under the reserved liquid crystal response time includes:

according to detected brightness of different display regions of the liquid crystal display screen under the reserved liquid crystal response time when each row of sub-pixel units of the liquid crystal display screen is provided with a same gray-scale voltage, obtaining N display regions to be compensated of the liquid crystal display screen that need grayscale compensation.

Optionally, the step of performing grayscale compensation on the display region according to the time comparison result, the grayscale conversion timetable and the compensation grayscale lookup table includes:

when the time comparison result indicates that the reserved liquid crystal response time is greater than or equal to the limit value of conversion time, acquiring a previous frame image data and a target frame image data, and performing grayscale compensation on a sub-pixel unit in the display region for compensation at a target frame time according to a previous frame grayscale, a target frame gray-scale of the sub-pixel unit and the compensation gray-scale lookup table corresponding to the display region for compensation; or, when the time comparison result indicates that the reserved liquid crystal response time is less than the limit value of conversion time, performing grayscale compensation on the display region according to the reserved liquid crystal response time, the grayscale conversion timetable and the compensation gray-scale lookup table;

the previous frame image data includes the previous frame grayscale of the sub-pixel unit in the display region for compensation, the target frame image data includes the target frame grayscale of the sub-pixel unit in the display region for compensation.

Optionally, the step of performing grayscale compensation on the display region according to the reserved liquid crystal response time, the gray-scale conversion timetable and the compensation grayscale lookup table includes:

acquiring the previous frame image data and the target frame image data, and obtaining a first grayscale conversion time according to the gray-scale conversion timetable of the display region for compensation, the previous frame gray-scale and the target frame gray-scale;

when the first grayscale conversion time is less than or equal to the reserved liquid crystal response time, providing a gray-scale voltage corresponding to the target frame gray-scale to the sub-pixel unit at the target frame time; or, when the first grayscale conversion time is greater than the reserved liquid crystal response time, comparing the target frame grayscale and the previous frame grayscale to obtain a grayscale comparison result, and performing grayscale compensation on the display region according to the reserved liquid crystal response time, the gray-scale comparison result, the grayscale conversion timetable and the compensation gray-scale lookup table.

Optionally, the grayscale conversion timetable records a time required for a brightness of a display region corresponding to a sub-pixel unit in the liquid crystal display screen to reach an expected brightness corresponding to a second predetermined grayscale when a grayscale provided to the sub-pixel unit is converted from a first predetermined grayscale to the second predetermined grayscale; both a number of the first predetermined grayscale and a number of the second predetermined grayscale are plural; in the gray-scale conversion timetable, a second predetermined gray-scale with a largest grayscale value is a largest second predetermined grayscale, and a second predetermined gray-scale with a smallest grayscale value is a smallest second predetermined gray-scale;

the step of performing grayscale compensation on the display region according to the reserved liquid crystal response time, the grayscale comparison result, the gray-scale conversion timetable and the compensation grayscale lookup table includes:

when the target frame grayscale is greater than the previous frame grayscale, obtaining a second grayscale conversion time according to the gray-scale conversion timetable, the previous frame grayscale and the largest second predetermined grayscale, and comparing the second gray-scale conversion time and the reserved liquid crystal response time; when the second grayscale conversion time is less than or equal to the reserved liquid crystal response time, performing gray-scale compensation on the sub-pixel unit according to the previous frame grayscale, the target frame grayscale and the compensation grayscale lookup table; when the second grayscale conversion time is greater than the reserved liquid crystal response time, setting a first initial grayscale which is less than the previous frame grayscale, and controlling a grayscale value of the first initial grayscale to be gradually decreased, and each time the grayscale value of the first initial grayscale is changed, obtaining a corresponding third grayscale conversion time according to the grayscale conversion timetable, the first initial grayscale and the largest second predetermined gray-scale, and when the third grayscale conversion time is less than or equal to the reserved liquid crystal response time, stop changing the grayscale value of the first initial gray-scale, and storing the first initial grayscale; at the target frame time, performing grayscale compensation on the sub-pixel unit according to the first initial gray-scale, the target frame grayscale, and the compensation grayscale lookup table; or, when the target frame grayscale is less than the previous frame grayscale, obtaining a fourth grayscale conversion time according to the gray-scale conversion timetable, the previous frame grayscale and the smallest second predetermined grayscale, and comparing the fourth grayscale conversion time and the reserved liquid crystal response time; when the fourth grayscale conversion time is less than or equal to the reserved liquid crystal response time, performing gray-scale compensation on the sub-pixel unit according to the previous frame grayscale, the target frame grayscale and the compensation grayscale lookup table; when the fourth grayscale conversion time is greater than the reserved liquid crystal response time, setting a second initial gray-scale which is greater than the previous frame gray-scale, and controlling a grayscale value of the second initial grayscale to be gradually increased, and each time the grayscale value of the second initial grayscale is changed, obtaining a corresponding fifth grayscale conversion time according to the gray-scale conversion timetable, the second initial grayscale and the smallest second predetermined grayscale, and when the obtained fifth grayscale conversion time is less than or equal to the reserved liquid crystal response time, stop changing the grayscale value of the second initial grayscale, and storing the second initial gray-scale; at the target frame time, performing grayscale compensation on the sub-pixel unit according to the second initial grayscale, the target frame grayscale, and the compensation grayscale lookup table.

Optionally, the grayscale compensation method according to an embodiment of the present disclosure further includes:

when the target frame grayscale is greater than the previous frame grayscale, the second grayscale conversion time is greater than the reserved liquid crystal response time, and all of the third grayscale conversion times are greater than the reserved liquid crystal response time, setting a first adjustment grayscale which is greater than the previous frame grayscale, and controlling a grayscale value of the first adjustment grayscale to be gradually increased, each time the grayscale value of the first adjustment grayscale is changed, obtaining a corresponding first adjustment gray-scale conversion time according to the grayscale conversion timetable, the first adjustment grayscale and the largest second predetermined grayscale, and when the first adjustment grayscale conversion time is less than or equal to the reserved liquid crystal response time, stop changing the grayscale value of the first adjustment grayscale, and storing the first adjustment grayscale; at the target frame time, performing grayscale compensation on the sub-pixel unit according to the first adjustment grayscale, the target frame grayscale, and the compensation gray-scale lookup table;

the first adjustment grayscale is less than the target frame gray-scale.

Optionally, the grayscale compensation method according to an embodiment of the present disclosure further includes:

when the target frame grayscale is less than the previous frame grayscale, the fourth grayscale conversion time is greater than the reserved liquid crystal response time, and all of the fifth grayscale conversion times are greater than the reserved liquid crystal response time, setting a second adjustment grayscale which is less than the previous frame grayscale, and controlling a grayscale value of the second adjustment grayscale to be gradually decreased, each time the grayscale value of the second adjustment grayscale is changed, obtaining a corresponding second adjustment gray-scale conversion time according to the grayscale conversion timetable, the second adjustment grayscale and the smallest second predetermined gray-scale, and when the second adjustment grayscale conversion time is less than or equal to the reserved liquid crystal response time, stop changing the grayscale value of the second adjustment grayscale, and storing the second adjustment grayscale; at the target frame time, performing grayscale compensation on the sub-pixel unit according to the second adjustment grayscale, the target frame grayscale, and the compensation grayscale lookup table;

the second adjustment grayscale is greater than the target frame gray-scale.

Optionally, the compensation grayscale lookup table records a compensation grayscale that is actually required to be provided to a test sub-pixel unit in the display region for compensation under the reserved liquid crystal response time when a grayscale provided to the test sub-pixel unit is converted from a third predetermined grayscale to a fourth predetermined grayscale while a brightness of a display region corresponding to the test sub-pixel unit is an expected brightness corresponding to the fourth predetermined gray-scale; both a number of the third predetermined grayscale and a number of the fourth predetermined grayscale are plural.

Optionally, the grayscale conversion timetable records a time required for a brightness of a display region corresponding to a sub-pixel unit in the liquid crystal display screen to reach an expected brightness corresponding to a second predetermined grayscale when a grayscale provided to the sub-pixel unit is converted from a first predetermined grayscale to the second predetermined grayscale; both a number of the first predetermined grayscale and a number of the second predetermined grayscale are plural; in the gray-scale conversion timetable, a second predetermined gray-scale with a largest grayscale value is a largest second predetermined grayscale, and a second predetermined gray-scale with a smallest grayscale value is a smallest second predetermined grayscale; the limit value of conversion time is a maximum value of a first limit value and a second limit value;

the first limit value is a maximum value of a time required for a brightness of a display region corresponding to a sub-pixel unit in the liquid crystal display screen to reach the expected brightness corresponding to the largest second predetermined grayscale when the grayscale provided to the sub-pixel unit is converted from the respective first predetermined grayscale to the largest second predetermined gray-scale;

the second limit value is a maximum value of a time required for a brightness of a display region corresponding to a sub-pixel unit in the liquid crystal display screen to reach the expected brightness corresponding to the smallest second predetermined grayscale when the grayscale provided to the sub-pixel unit is converted from the respective first predetermined grayscale to the smallest second predetermined gray-scale.

Optionally, under the reserved liquid crystal response time, when rows of sub-pixel units in an n-th display region for compensation in the liquid crystal display screen are provided with a same gray-scale voltage, a difference between a predetermined brightness and a brightness of each sub-pixel unit in the n-th display region for compensation is within an n-th predetermined difference range;

n is a positive integer less than or equal to N;

the brightness of each sub-pixel unit in the n-th display region for compensation is less than the predetermined brightness.

Optionally, the step of acquiring a compensation gray-scale lookup table of the display region for compensation includes: under the predetermined reserved liquid crystal response time, setting the previous frame grayscale provided to the test sub-pixel unit in the display region for compensation as the third predetermined gray-scale;

providing continuously a test grayscale to the test sub-pixel unit, detecting a brightness of the display region corresponding to the test sub-pixel unit when the test gray-scale is provided to the test sub-pixel unit, and when the detected brightness is the expected brightness corresponding to the fourth predetermined grayscale, setting the current test grayscale as the compensation grayscale that is actually required to be provided to the test sub-pixel unit.

The present disclosure further provides a grayscale compensation assembly applied to a liquid crystal display device including a liquid crystal display screen; the grayscale compensation assembly including a storage circuit and a compensation circuit;

the storage circuit stores a pre-detected display region for compensation in the liquid crystal display screen that needs grayscale compensation, a gray-scale conversion timetable of the liquid crystal display screen, a compensation gray-scale lookup table of the display region for compensation, and a limit value of conversion time of the liquid crystal display screen;

the compensation circuit is configured to, when the liquid crystal display screen is displaying, compare a reserved liquid crystal response time of the liquid crystal display screen and the limit value of conversion time to obtain a time comparison result, and perform grayscale compensation on the display region according to the time comparison result, the grayscale conversion timetable and the compensation grayscale lookup table.

The present disclosure further provides a liquid crystal display device including the above grayscale compensation assembly.

Optionally, the liquid crystal display device according to an embodiment of the present disclosure further includes a drive integrated circuit;

the grayscale compensation assembly is integrated into the drive integrated circuit.

BRIEF DESCRIPTION OF THE DRAWINGS

FIG. 4 is a schematic diagram of an embodiment of a gray-scale conversion timetable used in a grayscale compensation method according to an embodiment of the present disclosure;

FIG. 5 is a schematic diagram of a specific embodiment of the gray-scale conversion timetable;

FIG. 6 is a schematic diagram of an embodiment of a compensation grayscale lookup table used in a grayscale compensation method according to an embodiment of the present disclosure;

FIG. 7 is a schematic diagram of a specific embodiment of the compensation grayscale lookup table;

DETAILED DESCRIPTION

Hereinafter, the technical solutions in the embodiments of the present disclosure will be described clearly and thoroughly in conjunction with the drawings in the embodiments of the present disclosure. Obviously, the described embodiments are part of the embodiments of the present disclosure, but not all of the embodiments. Based on the embodiments in the present disclosure, all other embodiments obtained by a person of ordinary skill in the art without creative efforts should fall within the protection scope of the present disclosure.

The overdrive technology (OD) for grayscale compensation in liquid crystal display devices is generally based on the following principle: according to a compensation gray-scale lookup table, a gray-scale voltage applied to a sub-pixel unit is higher than a voltage corresponding to a target frame grayscale, so that the liquid crystal molecules rotate faster, when reaching a target liquid crystal inversion state, the gray-scale voltage falls back to the voltage corresponding to the target frame grayscale, thus effectively shortening the grayscale conversion time (that is, the time required for the complete inversion of the liquid crystal molecules). However, with the development of liquid crystal display screens, especially VR glasses, towards high PPI and high frame rate, the time reserved for liquid crystal response by these display screens with high PPI and high frame rate has become shorter. The overdrive method in the related art cannot ensure that all sub-pixel units can achieve the target liquid crystal inversion state within one frame, and cannot achieve precise adjustment of overdrive.

The main object of the present disclosure is to provide a gray-scale compensation method, a grayscale compensation assembly and a liquid crystal display device for solving the problem in the related art that it cannot ensure that all sub-pixel units can achieve the target liquid crystal inversion state within one frame and cannot achieve precise adjustment of overdrive.

Figure 1:
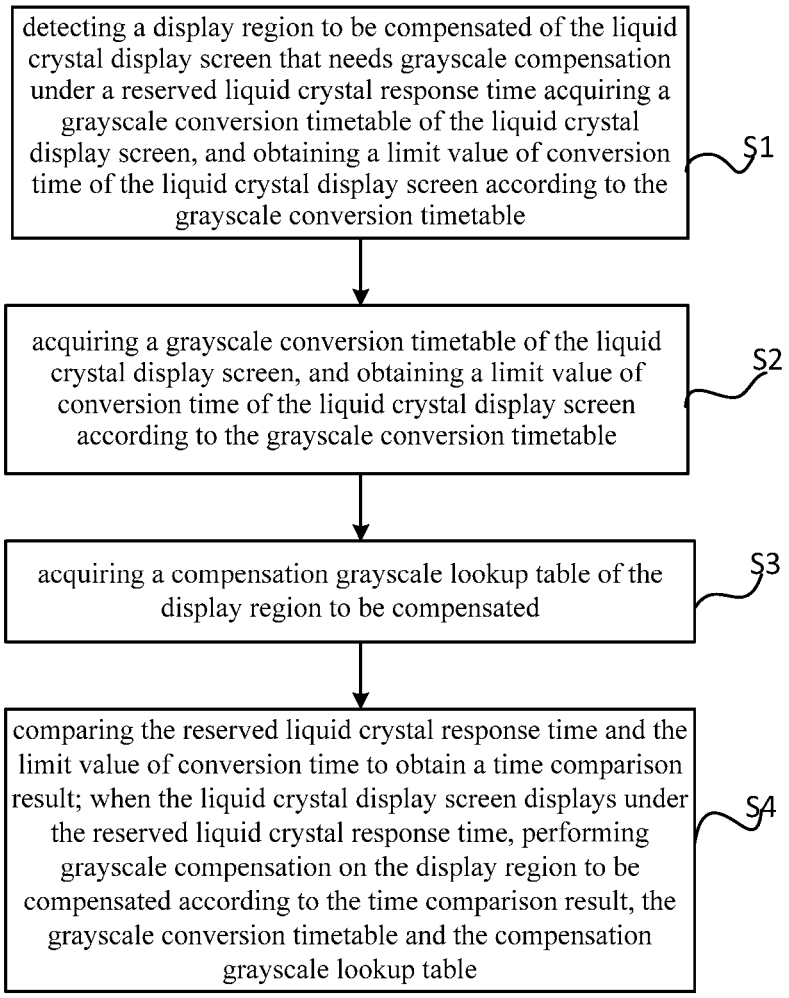
FIG. 1 is a flowchart of a grayscale compensation method according to an embodiment of the present disclosure.

In order to achieve the above object, an embodiment of the present disclosure provides a grayscale compensation method applied to a liquid crystal display device including a liquid crystal display screen; as shown in FIG. 1, the grayscale compensation method includes:

S1: detecting a display region for compensation in the liquid crystal display screen that needs grayscale compensation under a reserved liquid crystal response time, the reserved liquid crystal response time being a response time reserved for the liquid crystal of the liquid crystal display screen in one frame time;

S2: acquiring a grayscale conversion timetable of the liquid crystal display screen, and obtaining a limit value of conversion time of the liquid crystal display screen according to the grayscale conversion timetable;

S3: acquiring a compensation grayscale lookup table of the display region for compensation;

S4: comparing the reserved liquid crystal response time and the limit value of conversion time to obtain a time comparison result; when the liquid crystal display screen displays under the reserved liquid crystal response time, performing grayscale compensation on the display region according to the time comparison result, the grayscale conversion timetable and the compensation grayscale lookup table.

The grayscale compensation method according to the embodiment of the present disclosure detects a display region for compensation in the liquid crystal display screen that needs grayscale compensation under a reserved liquid crystal response time, acquires a grayscale conversion timetable of the liquid crystal display screen and a compensation grayscale lookup table of the display region for compensation, and obtains a limit value of conversion time of the liquid crystal display screen according to the grayscale conversion timetable. The embodiment of the present disclosure can perform grayscale compensation on the display region according to the limit value of conversion time, so as to ensure that all sub-pixel units can achieve the target liquid crystal inversion state within one frame when the reserved liquid crystal response time is short, achieving the precise adjustment of overdrive, and improving the phenomenon of insufficient brightness, smearing and so on.

In the embodiment of the present disclosure, the reserved liquid crystal response time may be a response time reserved for the liquid crystal in the liquid crystal display screen in one frame time.

In the embodiment of the present disclosure, the liquid crystal display screen adopts a strobe backlight mode. For example, the backlight circuit may be controlled to emit light during the last 10% of one frame time, and the backlight may be turned off during the first 90% of the one frame time; then, in a case that one frame time is 8.3 ms, and the time for scanning all rows of sub-pixel units included in the liquid crystal display screen is 3.8 ms, the response time reserved for the liquid crystal in the liquid crystal display screen can be (8.3-3.8-0.83) ms, that is, the reserved liquid crystal response time is (8.3-3.8-0.83) ms.

In the embodiment of the present disclosure, each row of sub-pixel units may be electrically connected to a row of gate lines, and all rows of sub-pixel units included in the liquid crystal display screen are electrically connected to multiple rows of gate lines. The time for scanning all rows of sub-pixel units included in the liquid crystal display screen may refer to a time for controlling the multiple rows of gate lines to turn on one by one so as to write a corresponding gray-scale voltage into each row of sub-pixel units.

Optionally, the number of the display region for compensation is N, and N is a positive integer;

the step of detecting the display region for compensation in the liquid crystal display screen under the reserved liquid crystal response time includes:

according to detected brightness of different display regions of the liquid crystal display screen under the reserved liquid crystal response time when each row of sub-pixel units of the liquid crystal display screen is provided with a same gray-scale voltage, obtaining N display regions to be compensated of the liquid crystal display screen that need grayscale compensation.

In the embodiment of the present disclosure, when N is greater than 1, the compensation grayscale lookup tables of different display regions to be compensated may be different from each other; or, the compensation grayscale lookup tables of at least two display regions to be compensated may be different.

In a specific implementation, the number of the display region for compensation may be at least one; in a specific implementation, the brightness may be tested from the first row of sub-pixel units to the last row of sub-pixel units of the liquid crystal display so as to determine the display region(s) to be compensated that needs/need grayscale compensation, and the display screen is partitioned according to the degree of incomplete response of the liquid crystal.

Figure 2:
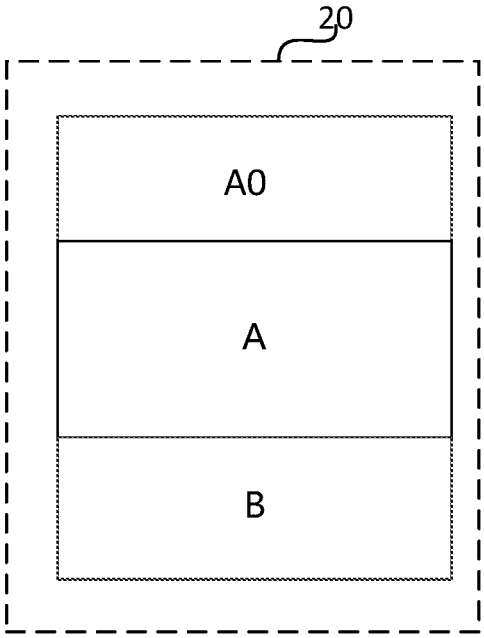
FIG. 2 is a diagram showing a division of a display region of a liquid crystal display screen.

Taking the 1800*1920 liquid crystal display screen as an example, it is known that, for LTPS (low temperature polysilicon) display products, when the reserved liquid crystal response time is 5 ms, the liquid crystal is completely inverted; when the reserved liquid crystal response time is 2 ms, the liquid crystal is not completely inverted. Then, when the reserved liquid crystal response time is 2 ms and in the strobe backlight mode, if the sub-pixel units included in the liquid crystal display screen are all provided with a gray-scale voltage corresponding to a gray-scale 160, different display regions of the liquid crystal display screen are detected, as shown in FIG. 2. It can be seen that the brightness of the uppermost display region A0 of the liquid crystal display screen 20 is equal to the brightness when the liquid crystal is completely inverted, indicating that in the uppermost display region A0, the sub-pixel units has achieved the target state and the liquid crystal is completely inverted. The uppermost display region A0 does not need the OD (overdrive) adjustment, that is, grayscale compensation is not required; however, the brightness of the first display region for compensation A in the middle of the liquid crystal display screen 20 and the brightness of the second display region for compensation B at the bottom of the liquid crystal display screen 20 are insufficient, indicating that the liquid crystal is not inverted to the target state, and thus the first display region for compensation A and the second display region for compensation B need the OD adjustment. In addition, the brightness of the bottom display region of the liquid crystal display screen 20 is less than that of the middle display region of the liquid crystal display screen 20, and the liquid crystal inversion angle is also smaller. Therefore, the first display region for compensation A and the second display region for compensation B should be subjected to grayscale compensation separately.

The embodiment of the present disclosure determines the display region for compensation that needs grayscale compensation by actually measuring the grayscale brightness at different positions of the liquid crystal display screen. Compared with the grayscale compensation for all rows, the grayscale compensation for the display region for compensation on the LCD screen is more accurate, saves cache space, and has faster calculation speed.

Figure 3:
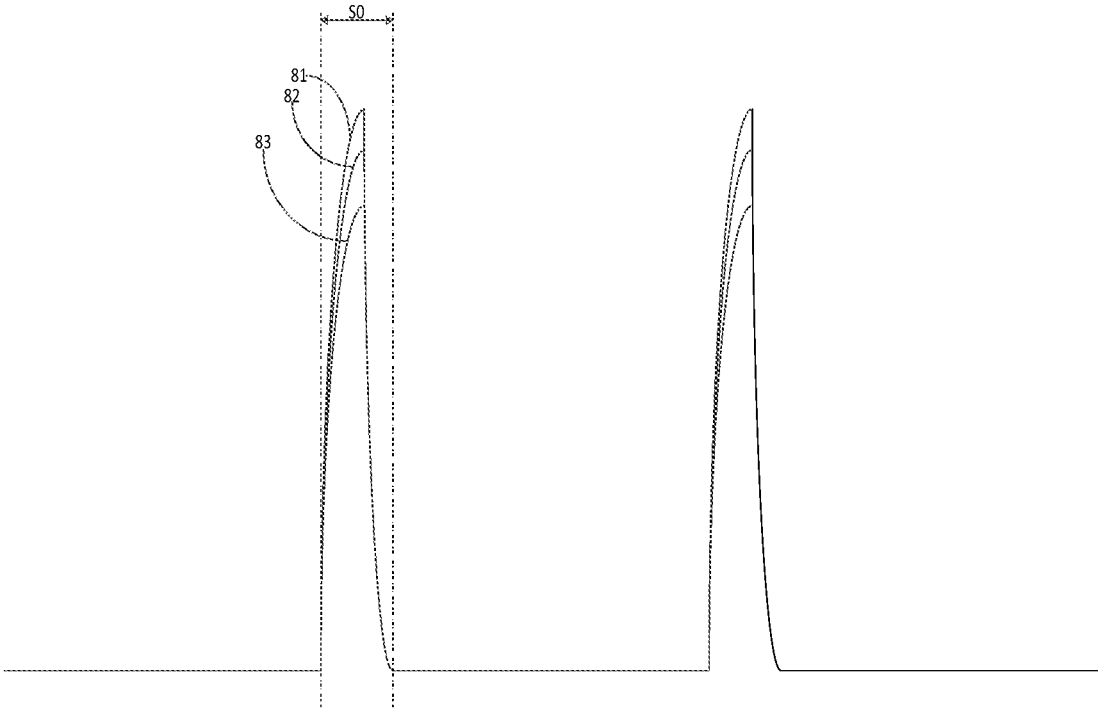
FIG. 3 is a schematic diagram of a brightness detection result of the liquid crystal display screen.

As shown in FIG. 3, in the brightness detection time period S0, the first curve 81 from top to bottom is the brightness curve of the uppermost display region A0, the second curve 82 from top to bottom is the brightness curve of the first display region for compensation A, and the third curve 83 from top to bottom is the brightness curve of the second display region for compensation B. In FIG. 3, the vertical axis indicates the brightness, and the horizontal axis indicates the time. In the brightness detection time period S0, the sub-pixel units in all regions of the liquid crystal display screen 20 are provided with a gray-scale voltage corresponding to the grayscale 160.

In the liquid crystal display screen 20 shown in FIG. 2, the gate lines may extend in the horizontal direction, the data lines may extend in the vertical direction, and multiple rows of gate lines may be arranged in the vertical direction. The multiple rows of gate lines may be scanned sequentially from top to bottom in one frame time. After scanning one row of gate line, the data voltage (the data voltage is also the gray-scale voltage) on the data line is written into the corresponding row of sub-pixel units, and then the liquid crystal is inverted based on the data voltage. Therefore, for the display regions from top to bottom of the liquid crystal display screen 20, the time reserved for liquid crystal response is reduced successively. Thus, the brightness of the display region at the bottom of the liquid crystal display screen 20 is less than that of the display region at the middle of the liquid crystal display screen 20, the brightness of the display region at the middle of the liquid crystal display screen 20 is less than that of the display region at the top of the liquid crystal display screen 20. In the embodiment of the present disclosure, the reserved liquid crystal response time of the liquid crystal display screen may be a time, within one frame, from the end of scanning the last row of grid line included in the liquid crystal display screen 20 to the time point when the backlight circuit is turned on and emits light, but not limited to this.

In the embodiment of the present disclosure, for different display regions to be compensated, the corresponding compensation grayscale lookup tables may be different, but it is not limited thereto.

In the embodiment of the present disclosure, the liquid crystal display screen may be VR (virtual reality) glasses or AR (augmented reality) glasses, but is not limited to this.

In the embodiment of the present disclosure, under the reserved liquid crystal response time, when the rows of sub-pixel units in an n-th display region for compensation in the liquid crystal display screen are provided with a same gray-scale voltage, a difference between a predetermined brightness and a brightness of each sub-pixel unit in the n-th display region for compensation is within an n-th predetermined difference range; the predetermined difference ranges are different;

n is a positive integer less than or equal to N;

the brightness of each sub-pixel unit in the n-th display region for compensation is less than the predetermined brightness. The predetermined brightness is a brightness of the display region of the liquid crystal display screen corresponding to the same gray-scale voltage when the reserved liquid crystal response time is long enough.

In the embodiment of the present disclosure, the same gray-scale voltage may be selected according to actual situations, for example, it may be the gray-scale voltage corresponding to the grayscale 160, but it is not limited thereto.

In a specific implementation, the display region for compensation in the liquid crystal display screen that needs grayscale compensation, the gray-scale conversion timetable of the liquid crystal display screen and the compensation grayscale lookup table of the display region for compensation may be detected before displaying of the liquid crystal display screen and after knowing the reserved liquid crystal response time of the liquid crystal display screen.

In the embodiment of the present disclosure, the grayscale conversion timetable records a time required for a brightness of a display region corresponding to a sub-pixel unit in the liquid crystal display screen to reach an expected brightness corresponding to a second predetermined grayscale when a grayscale provided to the sub-pixel unit is converted from a first predetermined grayscale to the second predetermined grayscale (that is, the previous frame grayscale is the first predetermined grayscale, and the target frame grayscale is the second predetermined grayscale; both the number of the first predetermined grayscale and the number of the second predetermined grayscale are plural; in the grayscale conversion timetable, the second predetermined grayscale with the largest grayscale value is the largest second predetermined grayscale, and the second predetermined grayscale with the smallest grayscale value is the smallest second predetermined gray-scale.

In the embodiment of the present disclosure, the grayscale conversion time is the time required for the liquid crystal to be completely inverted, but it is not limited thereto.

In a specific implementation, for example, the detected gray-scale conversion time may also be a conversion time required from the previous frame liquid crystal inversion angle to the target frame liquid crystal inversion angle A %, where A may be a positive number greater than or equal to 90 but less than or equal to 100.

In the embodiment of the grayscale conversion timetable as shown in FIG. 4, the label L11 denotes the first first predetermined grayscale, the label L12 denotes the second first predetermined grayscale, the label L13 denotes the third first predetermined grayscale, the label L14 denotes the fourth first predetermined grayscale, the label L15 denotes the fifth first predetermined grayscale, the label L16 denotes the sixth first predetermined grayscale, the label L17 denotes the seven first predetermined grayscale, the label L18 denotes the eighth first predetermined grayscale, the label L19 denotes the ninth first predetermined gray-scale;

the label L21 denotes the first second predetermined grayscale, the label L22 denotes the second second predetermined grayscale, the label L23 denotes the third second predetermined grayscale, the label L24 denotes the fourth second predetermined grayscale, the label L25 denotes the fifth second predetermined grayscale, the label L26 denotes the sixth second predetermined grayscale, the label L27 denotes the seven second predetermined grayscale, the label L28 denotes the eighth second predetermined grayscale, the label L29 denotes the ninth second predetermined gray-scale;

in FIG. 4, the label Aab denotes the time required for a brightness of a display region corresponding to the sub-pixel unit in the liquid crystal display screen to reach an expected brightness corresponding to L2*b* when the grayscale provided to the sub-pixel unit is converted from L1*a* to L2*b* (that is, the previous frame gray-scale is L1*a*, and the target frame grayscale is L2*b*);

a is a positive integer less than or equal to 9, and b is a positive integer less than or equal to 9.

When the grayscales of the liquid crystal display screen are grayscale 0 to grayscale 255, L11 may be grayscale 0, L12 may be grayscale 32, L13 may be grayscale 64, L14 may be grayscale 96, L15 may be grayscale 128, L16 may be grayscale 160, L17 may be grayscale 192, L18 may be grayscale 224, L19 may be grayscale 255, but they are not limited thereto;

when the grayscales of the liquid crystal display screen are grayscale 0 to grayscale 255, L21 may be grayscale 0, L22 may be grayscale 32, L23 may be grayscale 64, L24 may be grayscale 96, L25 may be grayscale 128, L26 may be grayscale 160, L27 may be grayscale 192, L28 may be grayscale 224, L29 may be grayscale 255, but they are not limited thereto;

Moreover, in the embodiment of the present disclosure, the number of the first predetermined grayscale and the number of the second predetermined grayscale can be selected according to actual situations, and are not limited to be equal to 9.

In the embodiment of the present disclosure, when the previous frame grayscale is not the first predetermined grayscale in the grayscale conversion timetable, and/or, the target frame grayscale is not the second predetermined gray-scale in the grayscale conversion timetable, the gray-scale conversion time from the previous frame grayscale to the target frame grayscale can be calculated according to the corresponding conversion time calculation algorithm and the grayscale conversion timetable.

In a specific implementation, the fact that the grayscale conversion time from the previous frame grayscale to the target frame grayscale is calculated according to the corresponding conversion time calculation algorithm and the grayscale conversion timetable may refer to: when the previous frame grayscale is not the first predetermined grayscale in the grayscale conversion timetable, and/or, the target frame grayscale is not the second predetermined grayscale in the gray-scale conversion timetable, selecting the first predetermined grayscale with the smallest difference from the previous frame grayscale and the second predetermined gray-scale with the smallest difference from the target frame grayscale, thereafter, obtaining the corresponding grayscale conversion time according to the grayscale conversion timetable, the first predetermined grayscale with the smallest difference from the previous frame grayscale and the second predetermined grayscale with the smallest difference from the target frame gray-scale.

In an actual operation, the conversion time calculation algorithm may also be another form of algorithm, and is not limited to the above example.

Optionally, the conversion time calculation algorithm may be a algorithm for calculating the grayscale conversion time, which is preset according to the parameters of the liquid crystal display screen. When the previous frame gray-scale is not the first predetermined grayscale, and/or the target frame grayscale is not the second predetermined grayscale, it is necessary to obtain the grayscale conversion time from the previous frame grayscale to the target frame grayscale according to the conversion time calculation algorithm and the grayscale conversion timetable. For example, when the given grayscale conversion timetable is as shown in FIG. 5, in a case that the grayscale conversion time from grayscale 1 to grayscale 33 (that is, the previous frame grayscale is 1, and the target frame grayscale is 33) is required, it is necessary to calculate and obtain the grayscale conversion time according to the conversion time calculation algorithm and in combination with the data in the grayscale conversion timetable shown in FIG. 5.

After the grayscale conversion timetable is detected, the limit value of conversion time can be determined according to the liquid crystal response timetable. Since the larger the difference between the previous frame grayscale and the target frame grayscale provided to the sub-pixel unit, the faster the liquid crystal inversion speed (however, in a case that the difference between the previous frame gray-scale and the target frame grayscale is 0, it can be set not to perform liquid crystal inversion), it is assumed that in FIG. 4, L21 is the second predetermined gray-scale with the smallest grayscale value, L21 is grayscale 0, L29 is the second predetermined grayscale with the largest grayscale value, L29 is grayscale 255; when converting from a lower grayscale to a higher grayscale (that is, the grayscale value of the target frame grayscale is greater than the grayscale value of the previous frame gray-scale), the grayscale conversion time from a lower grayscale to higher grayscale 255 is the shortest, and in FIG. 4, the grayscale conversion time from a lower grayscale to L29 is the shortest; when converting from a higher grayscale to a lower grayscale (that is, the grayscale value of the target frame grayscale is less than the grayscale value of the previous frame grayscale), the grayscale conversion time from a higher grayscale to gray-scale 0 is the shortest, and in FIG. 4, the grayscale conversion time from a higher grayscale to L21 is the shortest. On the other hand, the OD adjustment means that the applied gray-scale voltage is higher than the gray-scale voltage corresponding to the target frame grayscale, so that the liquid crystal rotates at a faster speed, and the liquid crystal is completely inverted. When the lower previous frame grayscale is converted to the higher target frame grayscale, the largest grayscale of the corresponding compensation is grayscale 255, and the grayscale conversion time of the corresponding lower grayscale to grayscale 255 is also the shortest gray-scale conversion time of the corresponding lower grayscale to a higher grayscale; similarly, when the higher previous frame grayscale is converted to the lower target frame grayscale, the largest grayscale of the corresponding compensation is grayscale 0; therefore, the maximum values of the last row and the first row in FIG. 4 are the limit values of conversion time.

Optionally, the limit value of conversion time is a maximum value of a first limit value and a second limit value;

the first limit value is a maximum value of a time required for a brightness of a display region corresponding to a sub-pixel unit in the liquid crystal display screen to reach the expected brightness corresponding to the largest second predetermined grayscale when the grayscale provided to the sub-pixel unit is converted from the respective first predetermined grayscale to the largest second predetermined grayscale (that is, the previous frame grayscale is the first predetermined grayscale, and the target frame grayscale is the largest second predetermined gray-scale);

the second limit value is a maximum value of a time required for a brightness of a display region corresponding to a sub-pixel unit in the liquid crystal display screen to reach the expected brightness corresponding to the smallest second predetermined grayscale when the grayscale provided to the sub-pixel unit is converted from the respective first predetermined grayscale to the smallest second predetermined grayscale (that is, the previous frame grayscale is the first predetermined grayscale, and the target frame grayscale is the smallest second predetermined gray-scale).

FIG. 5 shows a specific embodiment of the grayscale conversion timetable.

As shown in FIG. 5, the previous frame grayscale may be grayscale 0, grayscale 16, grayscale 32, grayscale 48, grayscale 64, grayscale 80, grayscale 96, grayscale 112, grayscale 128, grayscale 144, grayscale 160, grayscale 176, gray-scale 192, grayscale 208, grayscale 224, grayscale 240, and grayscale 255, respectively;

the target frame grayscale may be grayscale 0, grayscale 16, gray-scale 32, grayscale 48, grayscale 64, grayscale 80, grayscale 96, grayscale 112, gray-scale 128, grayscale 144, grayscale 160, grayscale 176, grayscale 192, grayscale 208, grayscale 224, grayscale 240, and grayscale 255, respectively;

according to the embodiment of the grayscale conversion timetable shown in FIG. 5, the limit value of conversion time is 1.907 ms.

In at least one embodiment of the present disclosure, the compensation grayscale lookup table records a compensation grayscale that is actually required to be provided to a test sub-pixel unit in the display region for compensation under the reserved liquid crystal response time when a grayscale provided to the test sub-pixel unit is converted from a third predetermined grayscale to a fourth predetermined grayscale (that is, the previous frame grayscale is the third predetermined gray-scale, and the target frame grayscale is the fourth predetermined grayscale) while a brightness of a display region corresponding to the test sub-pixel unit is an expected brightness corresponding to the fourth predetermined grayscale; both the number of the third predetermined grayscale and the number of the fourth predetermined grayscale are plural.

In a specific implementation, the compensation grayscale lookup table may be determined according to grayscale brightness relationship. First, under the condition of ensuring a complete response of the liquid crystal (for example, when the reserved liquid crystal response time is 5 ms), the brightness curve from the previous frame grayscale to the target frame grayscale is tested by using an optical probe, and then under the condition of an incomplete response of the liquid crystal (for example, when the reserved liquid crystal response time is less than 3 ms), the same brightness curve is tested. At this time, in the same strobe backlight mode, the target frame grayscale brightness D with a complete liquid crystal response is greater than the target frame grayscale brightness with an incomplete liquid crystal response. In this case, under the condition that the liquid crystal response is not complete, the gray-scale value of the target frame grayscale is continuously increased until the target frame grayscale brightness corresponding to the target frame grayscale is greater than or equal to the target frame grayscale brightness D with a complete liquid crystal response. It is determined that the target frame grayscale at this time is the compensation gray-scale.

In a specific implementation, the step of acquiring a compensation grayscale lookup table of the display region for compensation may include: under the predetermined reserved liquid crystal response time, setting the previous frame grayscale provided to the test sub-pixel unit in the display region for compensation as the third predetermined gray-scale;

changing successively a test grayscale provided to the test sub-pixel unit, detecting a brightness of the display region corresponding to the test sub-pixel unit when the test grayscale is provided to the test sub-pixel unit, and when the detected brightness is the expected brightness corresponding to the fourth predetermined grayscale, setting the current test grayscale as the compensation grayscale that is actually required to be provided to the test sub-pixel unit.

In the embodiment of the present disclosure, under the predetermined reserved liquid crystal response time, the liquid crystal of at least part of the sub-pixel units in the display region for compensation is not completely inverted; for example, the predetermined reserved liquid crystal response time may be less than or equal to 3 ms, but not limited to this.

In the embodiment of the present disclosure, in a case that the fourth predetermined grayscale is greater than the third predetermined grayscale, when the test grayscale is provided to the test sub-pixel unit, the selected test grayscale is greater than or equal to the fourth predetermined grayscale, and the grayscale value of the test grayscale can be gradually increased, but it is not limited thereto;

in a case that the fourth predetermined grayscale is less than the third predetermined grayscale, when the test grayscale is provided to the test sub-pixel unit, the selected test grayscale is less than or equal to the fourth predetermined gray-scale, and the grayscale value of the test grayscale can be gradually decreased, but it is not limited thereto.

Moreover, for different display regions to be compensated, the corresponding compensation grayscale lookup tables may be different, but it is not limited to this;

under different reserved liquid crystal display times, the corresponding compensation grayscale lookup tables may be different, but it is not limited to this.

In the embodiment of the present disclosure, the first predetermined grayscale in the grayscale conversion timetable may be selected to be the same as the third predetermined grayscale in the compensation grayscale lookup table, and the second predetermined grayscale in the grayscale conversion timetable may be selected to be the same as the fourth predetermined grayscale in the compensation grayscale lookup table, but they are not limited thereto.

In an actual operation, the first predetermined grayscale in the gray-scale conversion timetable may be selected to be at least partially the same as the third predetermined grayscale in the compensation grayscale lookup table, and the second predetermined grayscale in the grayscale conversion timetable may be selected to be at least partially the same as the fourth predetermined grayscale in the compensation grayscale lookup table.

In the embodiment of the compensation grayscale lookup table as shown in FIG. 6, the label L31 denotes the first third predetermined grayscale, the label L32 denotes the second third predetermined grayscale, the label L33 denotes the third third predetermined grayscale, the label L34 denotes the fourth third predetermined grayscale, the label L35 denotes the fifth third predetermined gray-scale, the label L36 denotes the sixth third predetermined grayscale, the label L37 denotes the seven third predetermined grayscale, the label L38 denotes the eighth third predetermined gray-scale, the label L39 denotes the ninth third predetermined gray-scale;

the label L41 denotes the first fourth predetermined grayscale, the label L42 denotes the second fourth predetermined grayscale, the label L43 denotes the third fourth predetermined grayscale, the label L44 denotes the fourth fourth predetermined grayscale, the label L45 denotes the fifth fourth predetermined grayscale, the label L46 denotes the sixth fourth predetermined grayscale, the label L47 denotes the seven fourth predetermined grayscale, the label L48 denotes the eight fourth predetermined grayscale, the label L49 denotes the ninth fourth predetermined gray-scale;

in FIG. 6, the label Hab denotes the compensation gray-scale required to be provided to a sub-pixel unit in the liquid crystal display screen when the gray-scale provided to the sub-pixel unit is converted from L3*a* to L4*b* (that is, the previous frame grayscale is L3*a*, and the target frame grayscale is L4*b*);

a is a positive integer less than or equal to 9, and b is a positive integer less than or equal to 9.

When the grayscales of the liquid crystal display screen are grayscale 0 to grayscale 255, L31 may be grayscale 0, L32 may be grayscale 32, L33 may be grayscale 64, L34 may be grayscale 96, L35 may be grayscale 128, L36 may be grayscale 160, L37 may be grayscale 192, L38 may be grayscale 224, L39 may be grayscale 255, but they are not limited thereto;

when the grayscales of the liquid crystal display screen are grayscale 0 to grayscale 255, L41 may be grayscale 0, L42 may be grayscale 32, L43 may be grayscale 64, L44 may be grayscale 96, L45 may be grayscale 128, L46 may be grayscale 160, L47 may be grayscale 192, L48 may be grayscale 224, L49 may be grayscale 255, but they are not limited thereto;

Moreover, in the embodiment of the present disclosure, the number of the third predetermined grayscale and the number of the fourth predetermined grayscale can be selected according to actual situations, and are not limited to be equal to 9.

According to the embodiment of the compensation gray-scale lookup table shown in FIG. 6, when the grayscale provided to the sub-pixel unit in the liquid crystal display is converted from L3*a* to L4*b* (that is, the previous frame grayscale is L3*a*, and the target frame grayscale is L4*b*), at the target frame time, the gray-scale actually required to be provided to the sub-pixel unit should be Hab, so that the brightness of the sub-pixel unit can reach the expected brightness;

in the embodiment of the present disclosure, when the previous frame grayscale is not the third predetermined grayscale in the compensation gray-scale lookup table, and/or, the target frame grayscale is not the fourth predetermined grayscale in the compensation grayscale lookup table, the compensation gray-scale required to be provided to the sub-pixel unit at the target frame time can be calculated according to the corresponding compensation grayscale calculation algorithm and the compensation grayscale lookup table.

In a specific implementation, the fact that the compensation gray-scale required to be provided to the sub-pixel unit at the target frame time is calculated according to the corresponding compensation grayscale calculation algorithm and the compensation grayscale lookup table may refer to: when the previous frame gray-scale is not the third predetermined grayscale in the compensation grayscale lookup table, and/or, the target frame grayscale is not the fourth predetermined grayscale in the compensation gray-scale lookup table, selecting the third predetermined gray-scale with the smallest difference from the previous frame grayscale and the fourth predetermined grayscale with the smallest difference from the target frame gray-scale, thereafter, obtaining the corresponding compensation grayscale according to the compensation grayscale lookup table, the third predetermined grayscale with the smallest difference from the previous frame grayscale and the fourth predetermined grayscale with the smallest difference from the target frame gray-scale.

In an actual operation, the compensation grayscale calculation algorithm may also be another form of algorithm, and is not limited to the above example.

Optionally, the compensation grayscale calculation algorithm may be a algorithm for calculating the compensation grayscale, which is preset according to the parameters of the display region for compensation. When the previous frame grayscale is not the third predetermined grayscale, and/or the target frame grayscale is not the fourth predetermined gray-scale, it is necessary to obtain the compensation grayscale required for conversion from the previous frame grayscale to the target frame grayscale according to the compensation grayscale calculation algorithm and the compensation gray-scale lookup table. For example, when the given compensation grayscale lookup table is as shown in FIG. 7, in a case that the compensation gray-scale from grayscale 1 to gray-scale 33 (that is, the previous frame grayscale is 1, and the target frame grayscale is 33) is required, it is necessary to calculate and obtain the compensation grayscale according to the compensation grayscale calculation algorithm and in combination with the data in the compensation grayscale lookup table shown in FIG. 7.

FIG. 7 shows a specific embodiment of the compensation gray-scale lookup table. The reserved liquid crystal response time corresponding to the embodiment of the compensation grayscale lookup table in FIG. 7 may be 1.8 ms, but is not limited thereto.

As shown in FIG. 7, the previous frame grayscale may be grayscale 0, grayscale 16, grayscale 32, grayscale 48, gray-scale 64, grayscale 80, grayscale 96, grayscale 112, gray-scale 128, grayscale 144, grayscale 160, grayscale 176, gray-scale 192, grayscale 208, grayscale 224, grayscale 240, and grayscale 255, respectively;

the target frame grayscale may be grayscale 0, grayscale 16, gray-scale 32, grayscale 48, grayscale 64, grayscale 80, grayscale 96, grayscale 112, gray-scale 128, grayscale 144, grayscale 160, grayscale 176, grayscale 192, grayscale 208, grayscale 224, grayscale 240, and grayscale 255, respectively;

in at least one embodiment of the present disclosure, the step of performing grayscale compensation on the display region according to the time comparison result, the gray-scale conversion timetable and the compensation gray-scale lookup table may include:

when the time comparison result indicates that the reserved liquid crystal response time is greater than or equal to the limit value of conversion time, acquiring a previous frame image data and a target frame image data, and performing grayscale compensation on a sub-pixel unit in the display region for compensation, at a target frame time, according to a previous frame grayscale of the sub-pixel unit in the display region for compensation, a target frame grayscale of the sub-pixel unit in the display region for compensation, and the compensation grayscale lookup table corresponding to the display region for compensation; or, when the time comparison result indicates that the reserved liquid crystal response time is less than the limit value of conversion time, performing grayscale compensation on the display region according to the reserved liquid crystal response time, the grayscale conversion timetable and the compensation gray-scale lookup table.

In the embodiment of the present disclosure, the previous frame grayscale of a sub-pixel unit in the display region for compensation refers to: the grayscale of the sub-pixel unit directly obtained according to the previous frame image data, and not necessarily the grayscale actually provided to the sub-pixel unit in the previous frame.

at the previous frame time, when it is necessary to perform gray-scale compensation on the sub-pixel unit, the grayscale actually provided to the sub-pixel unit at the previous frame time is the compensation grayscale corresponding to the previous frame, and at this time, the previous frame grayscale discussed with respect to the target frame may not be the compensation grayscale corresponding to the previous frame; at the previous frame time, when there is no need to perform compensation grayscale on the sub-pixel unit, the grayscale actually provided to the sub-pixel unit at the previous frame time may be the grayscale of the sub-pixel unit directly obtained according to the previous frame image data.

In the embodiment of the present disclosure, the step of, when the reserved liquid crystal response time is greater than or equal to the limit value of conversion time, performing grayscale compensation on a sub-pixel unit in the display region for compensation at the target frame time according to the previous frame grayscale of the sub-pixel unit in the display region for compensation, the target frame grayscale of the sub-pixel unit in the display region for compensation, and the compensation grayscale lookup table corresponding to the display region for compensation, may refer to:

looking up the corresponding compensation grayscale according to the previous frame grayscale of the sub-pixel unit in the display region for compensation, the target frame grayscale of the sub-pixel unit in the display region for compensation, and the compensation grayscale lookup table corresponding to the display region for compensation;

when the compensation grayscale is equal to the target frame gray-scale, there is no need to change the gray-scale voltage at the target frame time at this time, and the sub-pixel unit is provided with a gray-scale voltage corresponding to the target frame grayscale at the target frame time;

when the compensation grayscale is not equal to the target frame grayscale, the sub-pixel unit is provided with a gray-scale voltage corresponding to the compensation grayscale at the target frame time.

In the embodiment of the present disclosure, the step of, when the compensation grayscale is not equal to the target frame grayscale, performing grayscale compensation on a sub-pixel unit in the display region for compensation at the target frame time according to the previous frame grayscale of the sub-pixel unit in the display region for compensation, the target frame grayscale of the sub-pixel unit in the display region for compensation, and the compensation grayscale lookup table corresponding to the display region for compensation, may refer to: obtaining the compensation grayscale corresponding to the previous frame grayscale and the target frame grayscale according to the compensation grayscale lookup table and the compensation grayscale calculation algorithm, and at the target frame time, providing to the sub-pixel unit a gray-scale voltage corresponding to the compensation gray-scale; but it is not limited to this.

In a specific implementation, for the display region for compensation in the liquid crystal display screen, the grayscale conversion timetable of the liquid crystal display screen and the compensation grayscale lookup table of the display region for compensation (the compensation grayscale lookup table corresponds to the reserved liquid crystal response time) are detected, and, after obtaining the limit value of conversion time according to the grayscale conversion timetable, the limit value of conversion time is compared with the reserved liquid crystal response time;

when the reserved liquid crystal response time is greater than or equal to the limit value of conversion time, the previous frame image data and the target frame image data are acquired, and the previous frame image data includes the previous frame grayscale of the sub-pixel unit in the display region for compensation, and the target frame image data includes the target frame grayscale of the sub-pixel unit in the display region for compensation; and then, grayscale compensation is performed on the sub-pixel unit at the target frame time according to the previous frame grayscale, the target frame grayscale and the compensation grayscale lookup table corresponding to the display region for compensation;

when the reserved liquid crystal response time is less than the limit value of conversion time, grayscale compensation should be performed on the display region for compensation according to the reserved liquid crystal response time, the grayscale conversion timetable, and the compensation grayscale lookup table.

In the embodiment of the present disclosure, the previous frame grayscale of a sub-pixel unit in the display region for compensation refers to: the grayscale of the sub-pixel unit directly obtained according to the previous frame image data;

the target frame grayscale of a sub-pixel unit in the display region for compensation refers to: the grayscale of the sub-pixel unit directly obtained according to the target frame image data. Further, the step of performing grayscale compensation on the display region according to the reserved liquid crystal response time, the grayscale conversion timetable and the compensation grayscale lookup table includes:

acquiring the previous frame image data and the target frame image data, and obtaining a first grayscale conversion time according to the gray-scale conversion timetable of the display region for compensation, the previous frame grayscale and the target frame gray-scale;

when the first grayscale conversion time is less than or equal to the reserved liquid crystal response time, providing a gray-scale voltage corresponding to the target frame grayscale to the sub-pixel unit at the target frame time; or, when the first grayscale conversion time is greater than the reserved liquid crystal response time, comparing the target frame grayscale and the previous frame grayscale to obtain a grayscale comparison result, and performing grayscale compensation on the display region according to the reserved liquid crystal response time, the grayscale comparison result, the grayscale conversion timetable and the compensation grayscale lookup table.

In the embodiment of the present disclosure, the step of obtaining the first grayscale conversion time according to the grayscale conversion timetable of the display region for compensation, the previous frame grayscale and the target frame grayscale refers to: obtaining the first grayscale conversion time from the previous frame grayscale to the target frame grayscale according to the grayscale conversion timetable and the conversion time calculation algorithm; but it is not limited to this.

In a specific implementation, when the reserved liquid crystal response time is less than the limit value of conversion time, the previous frame image data and the target frame image data (the previous frame image data includes the previous frame grayscale, and the target frame image data includes the target frame gray-scale) are acquired, and the first grayscale conversion time is obtained;

when the first grayscale conversion time is less than or equal to the reserved liquid crystal response time, grayscale compensation does not need to be performed, and the gray-scale voltage is normally provided at this time;

when the first grayscale conversion time is greater than the reserved liquid crystal response time, it is necessary to perform grayscale compensation on the display region according to the grayscale comparison result, the reserved liquid crystal response time, the grayscale conversion timetable, and the compensation grayscale lookup table.

In a specific implementation, the grayscale conversion timetable records a time required for a brightness of a display region corresponding to a sub-pixel unit in the liquid crystal display screen to reach an expected brightness corresponding to a second predetermined grayscale when a grayscale provided to the sub-pixel unit is converted from a first predetermined grayscale to the second predetermined grayscale; both the number of the first predetermined grayscale and the number of the second predetermined grayscale are plural; in the grayscale conversion timetable, the second predetermined grayscale with the largest grayscale value is the largest second predetermined grayscale, and the second predetermined grayscale with the smallest grayscale value is the smallest second predetermined gray-scale;

optionally, the step of performing grayscale compensation on the display region according to the reserved liquid crystal response time, the gray-scale comparison result, the grayscale conversion timetable and the compensation gray-scale lookup table includes:

when the target frame grayscale is greater than the previous frame grayscale, obtaining a second grayscale conversion time according to the gray-scale conversion timetable, the previous frame grayscale and the largest second predetermined grayscale, and comparing the second grayscale conversion time and the reserved liquid crystal response time; when the second grayscale conversion time is less than or equal to the reserved liquid crystal response time, performing gray-scale compensation on the sub-pixel unit according to the previous frame grayscale, the target frame grayscale and the compensation grayscale lookup table; when the second grayscale conversion time is greater than the reserved liquid crystal response time, setting a first initial grayscale which is less than the previous frame grayscale, and controlling a grayscale value of the first initial grayscale to be gradually decreased, and each time the grayscale value of the first initial grayscale is changed, obtaining a corresponding third grayscale conversion time according to the grayscale conversion timetable, the first initial grayscale and the largest second predetermined grayscale, and when the third grayscale conversion time is less than or equal to the reserved liquid crystal response time, stop changing the grayscale value of the first initial grayscale, and storing the first initial grayscale; at the target frame time, performing grayscale compensation on the sub-pixel unit according to the first initial gray-scale, the target frame grayscale, and the compensation grayscale lookup table; or, when the target frame grayscale is less than the previous frame grayscale, obtaining a fourth grayscale conversion time according to the gray-scale conversion timetable, the previous frame grayscale and the smallest second predetermined grayscale, and comparing the fourth grayscale conversion time and the reserved liquid crystal response time; when the fourth grayscale conversion time is less than or equal to the reserved liquid crystal response time, performing gray-scale compensation on the sub-pixel unit according to the previous frame grayscale, the target frame grayscale and the compensation grayscale lookup table; when the fourth grayscale conversion time is greater than the reserved liquid crystal response time, setting a second initial grayscale which is greater than the previous frame gray-scale, and controlling a grayscale value of the second initial grayscale to be gradually increased, and each time the grayscale value of the second initial grayscale is changed, obtaining a corresponding fifth grayscale conversion time according to the gray-scale conversion timetable, the second initial grayscale and the smallest second predetermined grayscale, and when the fifth grayscale conversion time is less than or equal to the reserved liquid crystal response time, stop changing the grayscale value of the second initial grayscale, and storing the second initial grayscale; at the target frame time, performing grayscale compensation on the sub-pixel unit according to the second initial grayscale, the target frame grayscale, and the compensation gray-scale lookup table.

In a specific implementation, when the target frame grayscale is greater than the previous frame grayscale, and the second grayscale conversion time is greater than the reserved liquid crystal response time, the first initial grayscale is recorded in a storage after obtaining the final first initial grayscale, so that gray-scale compensation is performed on the sub-pixel unit at the target frame time according to the first initial grayscale, the target frame grayscale, and the compensation gray-scale lookup table.

In a specific implementation, when the target frame grayscale is less than the previous frame grayscale, and the fourth grayscale conversion time is greater than the reserved liquid crystal response time, the second initial gray scale is recorded in the storage after the final second initial grayscale is obtained, so that gray-scale compensation is performed on the sub-pixel unit at the target frame time according to the second initial grayscale, the target frame grayscale, and the compensation grayscale lookup table.

Optionally, when the second grayscale conversion time is greater than the reserved liquid crystal response time, the grayscale value of the first initial grayscale set at the beginning may be slightly different from the previous frame grayscale. For example, when the previous frame grayscale is 192, the grayscale value of the first initial grayscale set at the beginning may be 176, but it is not limited to this. Optionally, when the fourth grayscale conversion time is greater than the reserved liquid crystal response time, the grayscale value of the second initial grayscale set at the beginning may be slightly different from the previous frame grayscale. For example, when the previous frame grayscale is 176, the grayscale value of the second initial grayscale set at the beginning may be 192, but it is not limited to this.

In the embodiment of the present disclosure, the step of obtaining the second grayscale conversion time according to the grayscale conversion timetable, the previous frame grayscale and the largest second predetermined grayscale may refer to: according to the grayscale conversion timetable, obtaining the second gray-scale conversion time when the grayscale provided to the sub-pixel unit at the previous frame time is the previous frame grayscale and the grayscale provided to the sub-pixel unit at the target frame time is the largest second predetermined gray-scale.

Optionally, the fact that the grayscale value of the first initial gray-scale is gradually decreased refers to: each time the grayscale value of the first initial grayscale is changed, the grayscale value of the first initial grayscale is smaller than before the change.

Optionally, the first initial grayscale may be one of multiple first predetermined grayscales, or, the first initial grayscale may not be limited to the first predetermined gray-scale.

In the embodiment of the present disclosure, the step of obtaining the corresponding third grayscale conversion time according to the grayscale conversion timetable, the first initial grayscale and the largest second predetermined grayscale refers to: according to the grayscale conversion timetable, obtaining the third grayscale conversion time when the grayscale provided to the sub-pixel unit at the previous frame time is the first initial grayscale and the grayscale provided to the sub-pixel unit at the target frame time is the largest second predetermined gray-scale.

Optionally, the fact that the grayscale value of the second initial grayscale is gradually increased refers to: each time the grayscale value of the second initial grayscale is changed, the grayscale value of the second initial grayscale is larger than before the change.

Optionally, the second initial grayscale may be one of multiple first predetermined grayscales, or, the second initial grayscale may not be limited to the first predetermined gray-scale.

In the embodiment of the present disclosure, the step of obtaining a fourth grayscale conversion time according to the grayscale conversion timetable, the previous frame gray-scale and the smallest second predetermined grayscale may refer to: according to the grayscale conversion timetable, obtaining the fourth gray-scale conversion time when the grayscale provided to the sub-pixel unit at the previous frame time is the previous frame grayscale and the grayscale provided to the sub-pixel unit at the target frame time is the smallest second predetermined gray-scale.

In the embodiment of the present disclosure, the step of obtaining a corresponding fifth grayscale conversion time according to the grayscale conversion timetable, the second initial grayscale and the smallest second predetermined grayscale may refer to: according to the grayscale conversion timetable, obtaining the fifth grayscale conversion time when the grayscale provided to the sub-pixel unit at the previous frame time is the second initial grayscale and the grayscale provided to the sub-pixel unit at the target frame time is the smallest second predetermined gray-scale.

Optionally, the grayscale compensation method described in the embodiment of the present disclosure further includes:

when the target frame grayscale is greater than the previous frame grayscale, the second grayscale conversion time is greater than the reserved liquid crystal response time, and all of the third grayscale conversion times are greater than the reserved liquid crystal response time, setting a first adjustment grayscale which is greater than the previous frame grayscale, and controlling a grayscale value of the first adjustment grayscale to be gradually increased, each time the grayscale value of the first adjustment grayscale is changed, obtaining a corresponding first adjustment gray-scale conversion time according to the grayscale conversion timetable, the first adjustment grayscale and the largest second predetermined grayscale, and when the first adjustment grayscale conversion time is less than or equal to the reserved liquid crystal response time, stop changing the grayscale value of the first adjustment grayscale, and storing the first adjustment grayscale; at the target frame time, performing grayscale compensation on the sub-pixel unit according to the first adjustment grayscale, the target frame grayscale, and the compensation gray-scale lookup table;

the first adjustment grayscale is less than the target frame gray-scale.

In the embodiment of the present disclosure, the step of obtaining the corresponding first adjustment grayscale conversion time according to the gray-scale conversion timetable, the first adjustment grayscale and the largest second predetermined grayscale may refer to: according to the grayscale conversion timetable, obtaining the first adjustment grayscale conversion time when the grayscale provided to the sub-pixel unit at the previous frame time is the first adjustment grayscale and the grayscale provided to the sub-pixel unit at the target frame time is the largest second predetermined gray-scale.

In a specific implementation, when the target frame grayscale is greater than the previous frame grayscale, the second grayscale conversion time is greater than the reserved liquid crystal response time, and all of the third gray-scale conversion times are greater than the reserved liquid crystal response time, the first adjustment grayscale is recorded in a storage after obtaining the final first adjustment grayscale, so that grayscale compensation is performed on the sub-pixel unit at the target frame time according to the first adjustment grayscale, the target frame grayscale, and the compensation grayscale lookup table.

Optionally, the fact that the grayscale value of the first adjustment grayscale is gradually increased refers to: each time the grayscale value of the first adjustment grayscale is changed, the grayscale value of the first adjustment gray-scale is larger than before the change.

Optionally, the first adjustment grayscale may be one of multiple first predetermined grayscales, or, the first adjustment grayscale may not be limited to the first predetermined gray-scale.

Optionally, when the target frame grayscale is greater than the previous frame grayscale, the second grayscale conversion time is greater than the reserved liquid crystal response time, and all of the third grayscale conversion times are greater than the reserved liquid crystal response time, the grayscale value of the first adjustment grayscale set at the beginning may be slightly different from the previous frame grayscale. For example, when the previous frame grayscale is 32, the gray-scale value of the first adjustment grayscale set at the beginning may be 48, but it is not limited to this.

Optionally, the grayscale compensation method described in the embodiment of the present disclosure further includes:

when the target frame grayscale is less than the previous frame grayscale, the fourth grayscale conversion time is greater than the reserved liquid crystal response time, and all of the fifth grayscale conversion times are greater than the reserved liquid crystal response time, setting a second adjustment grayscale which is less than the previous frame grayscale, and controlling a grayscale value of the second adjustment grayscale to be gradually decreased, each time the grayscale value of the second adjustment grayscale is changed, obtaining a corresponding second adjustment gray-scale conversion time according to the grayscale conversion timetable, the second adjustment grayscale and the smallest second predetermined gray-scale, and when the second adjustment grayscale conversion time is less than or equal to the reserved liquid crystal response time, stop changing the grayscale value of the second adjustment grayscale, and storing the second adjustment grayscale; at the target frame time, performing grayscale compensation on the sub-pixel unit according to the second adjustment grayscale, the target frame grayscale, and the compensation grayscale lookup table;

the second adjustment grayscale is greater than the target frame gray-scale.

In the embodiment of the present disclosure, the step of obtaining the corresponding second adjustment grayscale conversion time according to the grayscale conversion timetable, the second adjustment grayscale and the smallest second predetermined grayscale may refer to: according to the grayscale conversion timetable, obtaining the second adjustment grayscale conversion time when the grayscale provided to the sub-pixel unit at the previous frame time is the second adjustment grayscale and the grayscale provided to the sub-pixel unit at the target frame time is the smallest second predetermined gray-scale.

In a specific implementation, when the target frame grayscale is less than the previous frame grayscale, the fourth grayscale conversion time is greater than the reserved liquid crystal response time, and all of the fifth grayscale conversion times are greater than the reserved liquid crystal response time, the second adjustment grayscale is recorded in the storage after obtaining the final second adjustment grayscale, so that grayscale compensation is performed on the sub-pixel unit at the target frame time according to the second adjustment grayscale, the target frame grayscale, and the compensation grayscale lookup table.

Optionally, the fact that the grayscale value of the second adjustment grayscale is gradually decreased refers to: each time the grayscale value of the second adjustment grayscale is changed, the grayscale value of the second adjustment grayscale is smaller than before the change.

Optionally, the second adjustment grayscale may be one of multiple first predetermined grayscales, or, the second adjustment grayscale may not be limited to the first predetermined gray-scale.

Optionally, when the target frame grayscale is less than the previous frame grayscale, the second grayscale conversion time is greater than the reserved liquid crystal response time, and all of the fifth grayscale conversion times are greater than the reserved liquid crystal response time, the grayscale value of the second adjustment grayscale set at the beginning may be slightly different from the previous frame grayscale. For example, when the previous frame grayscale is 48, the gray-scale value of the second adjustment gray-scale set at the beginning may be 32, but it is not limited to this.

In a specific implementation, when the first grayscale conversion time is greater than the reserved liquid crystal response time, the target frame grayscale is compared with the previous frame gray-scale;

when the target frame grayscale is greater than the previous frame grayscale, a second grayscale conversion time from the previous frame grayscale to the largest second predetermined grayscale is calculated according to the gray-scale conversion timetable and the conversion time calculation algorithm; the second grayscale conversion time is compared with the reserved liquid crystal response time;

when the second grayscale conversion time is less than or equal to the reserved liquid crystal response time, the compensation grayscale corresponding to the previous frame grayscale and the target frame grayscale is obtained according to the compensated grayscale lookup table and the compensation grayscale calculation algorithm, and at the target frame time, providing the compensation grayscale to the sub-pixel unit, so as to perform grayscale compensation on the sub-pixel unit;

when the second grayscale conversion time is greater than the reserved liquid crystal response time, a first initial grayscale which is less than the previous frame grayscale is set, and a grayscale value of the first initial grayscale is controlled to be gradually decreased, and each time the grayscale value of the first initial grayscale is changed, a third grayscale conversion time (the third gray-scale conversion time may be a grayscale conversion time in the grayscale conversion timetable corresponding to the first initial grayscale and the largest second predetermined gray-scale; the first initial grayscale may be one of multiple first predetermined grayscale, but is not limited thereto) is obtained according to the grayscale conversion timetable, the first initial grayscale and the largest second predetermined grayscale, and when the third grayscale conversion time is less than or equal to the reserved liquid crystal response time, changing of the grayscale value of the first initial grayscale is stopped, and the first initial grayscale is stored; according to the compensation grayscale lookup table and the compensation gray-scale calculation algorithm, the compensation grayscale corresponding to the first initial grayscale and the target frame grayscale is obtained, and the sub-pixel unit is provided with the compensation grayscale at the target frame time to perform gray-scale compensation on the sub-pixel unit.

when all the third grayscale conversion times are greater than the reserved liquid crystal response time, the first adjustment grayscale is set (the first adjustment grayscale is less than the target frame grayscale, and the first adjustment grayscale may be one of multiple first predetermined gray-scales, but is not limited to this), and the grayscale value of the first adjustment grayscale is controlled to be gradually increased, and each time the grayscale value of the first adjustment grayscale is changed, the first adjustment gray-scale conversion time is obtained according to the grayscale conversion timetable, the first adjustment grayscale, and the largest second predetermined grayscale. When the first adjustment gray-scale conversion time is less than or equal to the reserved liquid crystal response time, changing of the grayscale value of the first adjustment grayscale is stopped, and the first adjustment grayscale is stored; at the target frame time, according to the first adjustment grayscale, the target frame grayscale and the compensation gray-scale lookup table, grayscale compensation is performed on the sub-pixel unit;

In addition, when all the first adjustment grayscale conversion times are greater than the reserved liquid crystal response time, grayscale compensation is normally performed; at the target frame time, grayscale compensation is performed on the sub-pixel unit according to the previous frame grayscale, the target frame grayscale, and the compensation grayscale lookup table.

In the embodiment of the present disclosure, the first initial gray-scale may not be limited to one of multiple first predetermined grayscales, but may be any grayscale. In this case, the third grayscale conversion time is: the gray-scale conversion time from the first initial grayscale to the largest second predetermined grayscale obtained according to the grayscale conversion timetable and the conversion time calculation algorithm, but not limited to this.

In the embodiment of the present disclosure, the first adjustment grayscale may not be limited to one of multiple first predetermined grayscales. In this case, the first adjustment grayscale conversion time is: the grayscale conversion time from the first adjustment grayscale to the largest second predetermined gray-scale obtained according to the gray-scale conversion timetable and the conversion time calculation algorithm, but not limited to this.

In a specific implementation, when the first grayscale conversion time is greater than the reserved liquid crystal response time, the target frame grayscale is compared with the previous frame gray-scale;

when the target frame grayscale is less than the previous frame grayscale, the previous frame grayscale and the smallest second predetermined grayscale are obtained according to the grayscale conversion timetable and the conversion time calculation algorithm, and the fourth grayscale conversion time is obtained, and the fourth grayscale conversion time from the previous frame gray-scale to the smallest second predetermined grayscale is calculated; the fourth gray-scale conversion time is compared with the reserved liquid crystal response time;

when the fourth grayscale conversion time is less than or equal to the reserved liquid crystal response time, the compensation grayscale corresponding to the previous frame grayscale and the target frame grayscale is obtained according to the compensation grayscale lookup table and the compensation grayscale calculation algorithm, and at the target frame time, the compensation grayscale is provided to the sub-pixel unit to perform grayscale compensation on the sub-pixel unit;

when the fourth grayscale conversion time is greater than the reserved liquid crystal response time, a second initial grayscale which is greater than the previous frame grayscale is set, and a grayscale value of the second initial grayscale is controlled to be gradually increased, and each time the grayscale value of the second initial grayscale is changed, a fifth grayscale conversion time (the fifth gray-scale conversion time may be a grayscale conversion time in the gray-scale conversion timetable corresponding to the second initial grayscale and the smallest second predetermined grayscale, and the second initial grayscale may be one of multiple first predetermined grayscales, but is not limited to this) is obtained according to the grayscale conversion timetable, the second initial grayscale and the smallest second predetermined grayscale. When the fifth grayscale conversion time is less than or equal to the reserved liquid crystal response time, changing of the grayscale value of the second initial grayscale is stopped, and the second initial grayscale is stored; according to the compensation grayscale lookup table and the compensation gray-scale calculation algorithm, the compensation grayscale corresponding to the second initial grayscale and the target frame grayscale is obtained, and at the target frame time, the compensating grayscale is provided to the sub-pixel unit so as to perform gray-scale compensation on the sub-pixel unit;

When all the fifth grayscale conversion times are greater than the reserved liquid crystal response time, a second adjustment grayscale is set (the second adjustment grayscale is greater than the target frame grayscale, and the second adjustment grayscale may be one of multiple first predetermined grayscales, but is not limited to this), the second adjustment grayscale is smaller than the previous frame grayscale, and the grayscale value of the second adjustment grayscale is controlled to be gradually decreased; each time the grayscale value of the second adjustment grayscale is changed, a second adjustment grayscale conversion time is obtained according to the grayscale conversion timetable, the second adjustment grayscale, and the smallest second predetermined grayscale. When the second adjustment gray-scale conversion time is less than or equal to the reserved liquid crystal response time, changing of the grayscale value of the second adjustment grayscale is stopped, and the second adjustment grayscale is stored; at the target frame time, gray-scale compensation is performed on the sub-pixel unit according to the second adjustment grayscale, the target frame grayscale, and the compensation grayscale lookup table;

In addition, when all the second adjustment grayscale conversion times are greater than the reserved liquid crystal response time, the grayscale compensation is normally performed; at the target frame time, grayscale compensation is performed on the sub-pixel unit according to the previous frame grayscale, the target frame grayscale, and the compensation grayscale lookup table.

In the embodiment of the present disclosure, the second initial gray-scale may not be limited to one of multiple first predetermined grayscales, but may be any grayscale. In this case, the fifth grayscale conversion time is: the grayscale conversion time from the second initial grayscale to the smallest second predetermined gray-scale obtained according to the grayscale conversion timetable and the conversion time calculation algorithm, but it is not limited to this.

In the embodiment of the present disclosure, the second adjustment grayscale may not be limited to one of multiple first predetermined grayscales. In this case, the second adjustment grayscale conversion time is: the grayscale conversion time from the second adjustment grayscale to the smallest second predetermined grayscale obtained according to the grayscale conversion timetable and the conversion time calculation algorithm, but it is not limited to this.

For example, when the grayscale conversion timetable of the liquid crystal display screen is as shown in FIG. 5 (the limit value of conversion time is 1.907 ms), the compensation grayscale lookup table of a display region for compensation on the liquid crystal display screen is as shown in FIG. 7. When the reserved liquid crystal response time of the liquid crystal display screen is 1.8 ms, since 1.8 ms is less than 1.907 ms, the grayscale compensation should be performed according to the reserved liquid crystal response time, the grayscale conversion timetable shown in FIG. 5, and the compensation grayscale lookup table shown in FIG. 7;

When the previous frame grayscale is grayscale 192 and the next frame grayscale is grayscale 240, the corresponding grayscale conversion time found from the grayscale conversion timetable shown in FIG. 5 is 1.943 ms, and 1.943 ms is greater than 1.8 ms. Furthermore, the grayscale conversion time from grayscale 192 to grayscale 255 in the grayscale conversion timetable shown in FIG. 5 is 1.907 ms, and 1.907 ms is also greater than 1.8 ms. Thus, the grayscale value of the previous frame grayscale will be gradually decreased. When the previous frame grayscale is 176 and the next frame grayscale is 255, the corresponding grayscale conversion time in FIG. 5 is 1.661 ms, 1.661 ms is less than 1.8 ms. At this time, according to the compensation grayscale lookup table shown in FIG. 7, the compensation grayscale corresponding to the precious frame grayscale of grayscale 176 and the next frame grayscale of grayscale 240 is found as 252. And thus, at the target frame time, the gray-scale voltage provided to the sub-pixel unit will be adjusted to the gray-scale voltage corresponding to grayscale 252.

Figure 8:
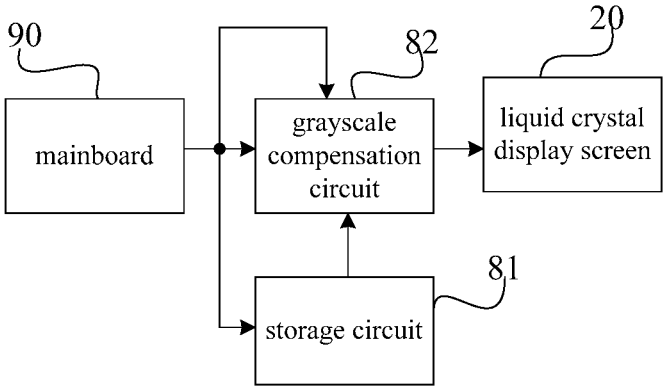
FIG. 8 is a structural diagram of a grayscale compensation assembly according to an embodiment of the present disclosure.

A grayscale compensation assembly according to an embodiment of the present disclosure is applied to a liquid crystal display device. As shown in FIG. 8, the liquid crystal display device includes a liquid crystal display screen 20; the gray-scale compensation assembly includes a storage circuit 81 and a compensation circuit 82;

the storage circuit 81 stores a pre-detected display region for compensation in the liquid crystal display screen 20 that needs gray-scale compensation, a grayscale conversion timetable of the liquid crystal display screen, a compensation grayscale lookup table of the display region for compensation, and a limit value of conversion time of the liquid crystal display screen 20;

the grayscale compensation circuit 82 is connected electrically to the storage circuit 81 and the liquid crystal display screen 20, respectively, and is configured to, when the liquid crystal display screen 20 is displaying, compare a reserved liquid crystal response time of the liquid crystal display screen 20 and the limit value of conversion time to obtain a time comparison result, and perform grayscale compensation on the display region according to the time comparison result, the grayscale conversion timetable and the compensation grayscale lookup table.

In a specific implementation, the storage circuit 81 and the gray-scale compensation circuit 82 may be integrated in the drive IC (Integrated Circuit), as shown in FIG. 8, and the grayscale compensation circuit 82 may be electrically connected to the motherboard 90 through the MIPI interface (Mobile Industry Processor Interface) so as to receive image data, but not limited to this.

When the embodiment of the present disclosure is working, the motherboard transmits the target frame image data and the compensation gray-scale lookup table to the drive IC through the MIPI interface, and the drive IC transmits the target frame image data and the compensation grayscale lookup table to the gray-scale compensation circuit 82. The previous frame image data is stored in the storage circuit, and the target frame image data and the compensation grayscale lookup table are also stored in the storage circuit. The grayscale compensation circuit 82 extracts the previous frame image data from the storage circuit, performs gray-scale compensation according to the lookup table, and provides the compensation grayscale to the sub-pixel unit, achieving the overdrive function and shortens the liquid crystal response time.

Optionally, the storage circuit may be a RAM (random access memory), but is not limited to this.

The liquid crystal display device according to the embodiment of the present disclosure includes the above-mentioned grayscale compensation assembly.

In a specific implementation, the liquid crystal display device described in the embodiment of the present disclosure further includes a drive integrated circuit;

The grayscale compensation circuit may be integrated in the drive integrated circuit.

The display device provided by the embodiment of the present disclosure may be any product or component with a display function, such as a mobile phone, a tablet computer, a television, a monitor, a notebook computer, a digital photo frame, a navigator, and the like.

The above are the preferred embodiments of the present disclosure. It should be noted that for those of ordinary skill in the art, several improvements and modifications can be made without departing from the principles described in the present disclosure, and these improvements and modifications should be also regarded as the protection scope of the present disclosure.

What is claimed is:

1. A grayscale compensation method applied to a liquid crystal display device comprising a liquid crystal display screen; the grayscale compensation method comprising:

detecting a display region for compensation in the liquid crystal display screen that needs grayscale compensation under a reserved liquid crystal response time, the reserved liquid crystal response time being a response time reserved for the liquid crystal of the liquid crystal display screen in one frame time;

acquiring a grayscale conversion timetable of the liquid crystal display screen, and obtaining a limit value of conversion time of the liquid crystal display screen according to the grayscale conversion timetable;

acquiring a compensation grayscale lookup table of the display region for compensation;

comparing the reserved liquid crystal response time and the limit value of conversion time to obtain a time comparison result; when the liquid crystal display screen displays under the reserved liquid crystal response time, performing gray-scale compensation on the display region according to the time comparison result, the grayscale conversion timetable and the compensation grayscale lookup table.

2. The grayscale compensation method according to claim 1, wherein a number of the display region for compensation is N, and N is a positive integer;

the step of detecting the display region for compensation in the liquid crystal display screen under the reserved liquid crystal response time comprises:

according to detected brightness of different display regions of the liquid crystal display screen under the reserved liquid crystal response time when each row of sub-pixel units of the liquid crystal display screen is provided with a same gray-scale voltage, obtaining N display regions to be compensated of the liquid crystal display screen that need grayscale compensation.

3. The grayscale compensation method according to claim 2, wherein, under the reserved liquid crystal response time, when rows of sub-pixel units in an n-th display region for compensation in the liquid crystal display screen are provided with a same gray-scale voltage, a difference between a predetermined brightness and a brightness of each sub-pixel unit in the n-th display region for compensation is within an n-th predetermined difference range;

n is a positive integer less than or equal to N;

the brightness of each sub-pixel unit in the n-th display region for compensation is less than the predetermined brightness.

4. The grayscale compensation method according to claim 1, wherein the step of performing grayscale compensation on the display region according to the time comparison result, the grayscale conversion timetable and the compensation gray-scale lookup table comprises:

when the time comparison result indicates that the reserved liquid crystal response time is greater than or equal to the limit value of conversion time, acquiring a previous frame image data and a target frame image data, and performing gray-scale compensation on a sub-pixel unit in the display region for compensation at a target frame time according to a previous frame grayscale, a target frame grayscale of the sub-pixel unit and the compensation grayscale lookup table corresponding to the display region for compensation; or, when the time comparison result indicates that the reserved liquid crystal response time is less than the limit value of conversion time, performing gray-scale compensation on the display region according to the reserved liquid crystal response time, the grayscale conversion timetable and the compensation grayscale lookup table;

the previous frame image data comprises the previous frame grayscale of the sub-pixel unit in the display region for compensation, the target frame image data comprises the target frame grayscale of the sub-pixel unit in the display region for compensation.

5. The grayscale compensation method according to claim 4, wherein the step of performing grayscale compensation on the display region according to the reserved liquid crystal response time, the grayscale conversion timetable and the compensation grayscale lookup table comprises:

acquiring the previous frame image data and the target frame image data, and obtaining a first grayscale conversion time according to the grayscale conversion timetable of the display region for compensation, the previous frame grayscale and the target frame grayscale;

when the first grayscale conversion time is less than or equal to the reserved liquid crystal response time, providing a gray-scale voltage corresponding to the target frame grayscale to the sub-pixel unit at the target frame time; or, when the first grayscale conversion time is greater than the reserved liquid crystal response time, comparing the target frame grayscale and the previous frame grayscale to obtain a grayscale comparison result, and performing grayscale compensation on the display region according to the reserved liquid crystal response time, the gray-scale comparison result, the grayscale conversion timetable and the compensation gray-scale lookup table.

6. The grayscale compensation method according to claim 5, wherein the grayscale conversion timetable records a time required for a brightness of a display region corresponding to a sub-pixel unit in the liquid crystal display screen to reach an expected brightness corresponding to a second predetermined grayscale when a grayscale provided to the sub-pixel unit is converted from a first predetermined gray-scale to the second predetermined grayscale; both a number of the first predetermined grayscale and a number of the second predetermined grayscale are plural; in the grayscale conversion timetable, a second predetermined grayscale with a largest grayscale value is a largest second predetermined grayscale, and a second predetermined grayscale with a smallest grayscale value is a smallest second predetermined gray-scale;

the step of performing grayscale compensation on the display region according to the reserved liquid crystal response time, the grayscale comparison result, the grayscale conversion timetable and the compensation grayscale lookup table comprises:

when the target frame grayscale is greater than the previous frame gray-scale, obtaining a second grayscale conversion time according to the grayscale conversion timetable, the previous frame grayscale and the largest second predetermined grayscale, and comparing the second grayscale conversion time and the reserved liquid crystal response time; when the second grayscale conversion time is less than or equal to the reserved liquid crystal response time, performing gray-scale compensation on the sub-pixel unit according to the previous frame grayscale, the target frame grayscale and the compensation grayscale lookup table; when the second grayscale conversion time is greater than the reserved liquid crystal response time, setting a first initial grayscale which is less than the previous frame grayscale, and controlling a grayscale value of the first initial grayscale to be gradually decreased, and each time the grayscale value of the first initial grayscale is changed, obtaining a corresponding third grayscale conversion time according to the grayscale conversion timetable, the first initial grayscale and the largest second predetermined gray-scale, and when the third grayscale conversion time is less than or equal to the reserved liquid crystal response time, stop changing the grayscale value of the first initial grayscale, and storing the first initial grayscale; at the target frame time, performing grayscale compensation on the sub-pixel unit according to the first initial gray-scale, the target frame grayscale, and the compensation grayscale lookup table; or, when the target frame grayscale is less than the previous frame gray-scale, obtaining a fourth grayscale conversion time according to the grayscale conversion timetable, the previous frame grayscale and the smallest second predetermined grayscale, and comparing the fourth grayscale conversion time and the reserved liquid crystal response time; when the fourth grayscale conversion time is less than or equal to the reserved liquid crystal response time, performing grayscale compensation on the sub-pixel unit according to the previous frame grayscale, the target frame grayscale and the compensation grayscale lookup table; when the fourth gray-scale conversion time is greater than the reserved liquid crystal response time, setting a second initial grayscale which is greater than the previous frame grayscale, and controlling a grayscale value of the second initial grayscale to be gradually increased, and each time the grayscale value of the second initial grayscale is changed, obtaining a corresponding fifth grayscale conversion time according to the grayscale conversion timetable, the second initial grayscale and the smallest second predetermined grayscale, and when the obtained fifth grayscale conversion time is less than or equal to the reserved liquid crystal response time, stop changing the grayscale value of the second initial grayscale, and storing the second initial grayscale; at the target frame time, performing grayscale compensation on the sub-pixel unit according to the second initial grayscale, the target frame grayscale, and the compensation gray-scale lookup table.

7. The grayscale compensation method according to claim 6, further comprising:

when the target frame grayscale is greater than the previous frame gray-scale, the second grayscale conversion time is greater than the reserved liquid crystal response time, and all of the third grayscale conversion times are greater than the reserved liquid crystal response time, setting a first adjustment grayscale which is greater than the previous frame grayscale, and controlling a grayscale value of the first adjustment grayscale to be gradually increased, each time the grayscale value of the first adjustment grayscale is changed, obtaining a corresponding first adjustment grayscale conversion time according to the grayscale conversion timetable, the first adjustment grayscale and the largest second predetermined grayscale, and when the first adjustment grayscale conversion time is less than or equal to the reserved liquid crystal response time, stop changing the grayscale value of the first adjustment grayscale, and storing the first adjustment grayscale; at the target frame time, performing gray-scale compensation on the sub-pixel unit according to the first adjustment grayscale, the target frame gray-scale, and the compensation gray-scale lookup table;

the first adjustment grayscale is less than the target frame gray-scale.

8. The grayscale compensation method according to claim 6, further comprising:

when the target frame grayscale is less than the previous frame grayscale, the fourth grayscale conversion time is greater than the reserved liquid crystal response time, and all of the fifth grayscale conversion times are greater than the reserved liquid crystal response time, setting a second adjustment grayscale which is less than the previous frame grayscale, and controlling a gray-scale value of the second adjustment grayscale to be gradually decreased, each time the grayscale value of the second adjustment grayscale is changed, obtaining a corresponding second adjustment grayscale conversion time according to the grayscale conversion timetable, the second adjustment grayscale and the smallest second predetermined grayscale, and when the second adjustment grayscale conversion time is less than or equal to the reserved liquid crystal response time, stop changing the grayscale value of the second adjustment grayscale, and storing the second adjustment grayscale; at the target frame time, performing grayscale compensation on the sub-pixel unit according to the second adjustment grayscale, the target frame grayscale, and the compensation grayscale lookup table;

the second adjustment grayscale is greater than the target frame gray-scale.

9. The grayscale compensation method according to claim 1, wherein the compensation grayscale lookup table records a compensation grayscale that is actually required to be provided to a test sub-pixel unit in the display region for compensation under the reserved liquid crystal response time when a grayscale provided to the test sub-pixel unit is converted from a third predetermined grayscale to a fourth predetermined grayscale while a brightness of a display region corresponding to the test sub-pixel unit is an expected brightness corresponding to the fourth predetermined gray-scale; both a number of the third predetermined grayscale and a number of the fourth predetermined grayscale are plural.

10. The grayscale compensation method according to claim 9, wherein the step of acquiring a compensation grayscale lookup table of the display region for compensation comprises: under the predetermined reserved liquid crystal response time, setting the previous frame grayscale provided to the test sub-pixel unit in the display region for compensation as the third predetermined gray-scale;

providing continuously a test grayscale to the test sub-pixel unit, detecting a brightness of the display region corresponding to the test sub-pixel unit when the test grayscale is provided to the test sub-pixel unit, and when the detected brightness is the expected brightness corresponding to the fourth predetermined grayscale, setting the current test grayscale as the compensation grayscale that is actually required to be provided to the test sub-pixel unit.

11. The grayscale compensation method according to claim 1, wherein the grayscale conversion timetable records a time required for a brightness of a display region corresponding to a sub-pixel unit in the liquid crystal display screen to reach an expected brightness corresponding to a second predetermined grayscale when a grayscale provided to the sub-pixel unit is converted from a first predetermined grayscale to the second predetermined grayscale; both a number of the first predetermined grayscale and a number of the second predetermined grayscale are plural; in the gray-scale conversion timetable, a second predetermined gray-scale with a largest grayscale value is a largest second predetermined grayscale, and a second predetermined gray-scale with a smallest grayscale value is a smallest second predetermined grayscale; the limit value of conversion time is a maximum value of a first limit value and a second limit value;

the first limit value is a maximum value of a time required for a brightness of a display region corresponding to a sub-pixel unit in the liquid crystal display screen to reach the expected brightness corresponding to the largest second predetermined grayscale when the gray-scale provided to the sub-pixel unit is converted from the respective first predetermined grayscale to the largest second predetermined gray-scale;

the second limit value is a maximum value of a time required for a brightness of a display region corresponding to a sub-pixel unit in the liquid crystal display screen to reach the expected brightness corresponding to the smallest second predetermined grayscale when the grayscale provided to the sub-pixel unit is converted from the respective first predetermined gray-scale to the smallest second predetermined gray-scale.

12. A grayscale compensation assembly applied to a liquid crystal display device comprising a liquid crystal display screen; the grayscale compensation assembly comprising a storage circuit and a compensation circuit;

the storage circuit stores a pre-detected display region for compensation in the liquid crystal display screen that needs grayscale compensation, a gray-scale conversion timetable of the liquid crystal display screen, a compensation gray-scale lookup table of the display region for compensation, and a limit value of conversion time of the liquid crystal display screen;

the compensation circuit is configured to, when the liquid crystal display screen is displaying, compare a reserved liquid crystal response time of the liquid crystal display screen and the limit value of conversion time to obtain a time comparison result, and perform grayscale compensation on the display region according to the time comparison result, the grayscale conversion timetable and the compensation grayscale lookup table.

13. A liquid crystal display device comprising the gray-scale compensation assembly according to claim 12.

14. The liquid crystal display device according to claim 13, further comprising a drive integrated circuit;

the grayscale compensation assembly is integrated into the drive integrated circuit.

* * * * *